US007661805B2

(12) United States Patent
Usui

(10) Patent No.: US 7,661,805 B2
(45) Date of Patent: Feb. 16, 2010

(54) INK-JET PRINTER

(75) Inventor: Takamasa Usui, Ogaki (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 407 days.

(21) Appl. No.: 11/125,954

(22) Filed: May 10, 2005

(65) Prior Publication Data

US 2005/0253909 A1 Nov. 17, 2005

(30) Foreign Application Priority Data

May 12, 2004 (JP) ..... 2004-142541
May 12, 2004 (JP) ..... 2004-142542

(51) Int. Cl.
*B41J 2/19* (2006.01)
*B41J 2/175* (2006.01)

(52) U.S. Cl. ..... 347/92; 347/85

(58) Field of Classification Search ..... 347/30, 347/85, 86, 92
See application file for complete search history.

(56) References Cited

U.S. PATENT DOCUMENTS

| | | | | |
|---|---|---|---|---|
| 5,847,734 | A | 12/1998 | Pawlowski, Jr. et al. | |
| 6,447,084 | B1 * | 9/2002 | Uetsuki et al. | 347/7 |
| 7,410,248 | B2 * | 8/2008 | Umeda et al. | 347/85 |
| 2002/0196316 | A1 | 12/2002 | Nakamura | |
| 2003/0016265 | A1 * | 1/2003 | Harada et al. | 347/29 |
| 2004/0056918 | A1 | 3/2004 | Wang et al. | |

FOREIGN PATENT DOCUMENTS

| | | | |
|---|---|---|---|
| JP | 2000 103084 | | 4/2000 |
| JP | 2002 240310 | | 8/2002 |
| JP | 2002-240310 | | 8/2002 |
| JP | 2004-114648 | | 4/2004 |
| JP | 2004-255861 | * | 9/2004 |
| JP | 2004-255862 | * | 9/2004 |
| JP | 2005-074827 | * | 3/2005 |
| WO | WO 2004/069545 | | 8/2004 |
| WO | WO 2004/069545 A1 | | 8/2004 |

* cited by examiner

*Primary Examiner*—Stephen D Meier
*Assistant Examiner*—Geoffrey Mruk
(74) *Attorney, Agent, or Firm*—Day Pitney LLP

(57) ABSTRACT

An ink-jet printer including: a buffer tank; an air-discharging valve device; and a valve opening-and-closing device. The ink-jet printer further includes an operating member which is arranged to be interposed between the air-discharging valve device and the valve opening-and-closing device. The valve opening-and-closing device operates the air-discharging valve device via the operating member, such that the air-discharging valve device is placed in a valve-open state and a valve-close state. The ink-jet printer is arranged to execute a first discharge operation in which the air separated from the ink in the buffer tank is discharged while placing the air-discharging valve device in the valve open state, and a second discharge operation in which an inside of the air-discharging valve device is exhausted to remove the ink remaining in the air-discharging valve device while placing the air-discharging valve device in the valve-close state.

34 Claims, 14 Drawing Sheets

INK-JET PRINTER

This application is based on Japanese Patent Application Nos. 2004-142541 and 2004-142542 filed on May 12, 2004, the contents of which are incorporated hereinto by reference.

BACKGROUND OF THE INVENTION

1. Field of the Invention

The present invention relates to an ink-jet printer, in particular, an ink-jet printer capable of accumulating bubbles separated from ink in an ink path and discharging the bubbles.

2. Discussion of Related Art

To assure a reduction in the size (the thickness) of an ink-jet printer, there is a demand for a reduction in the size (the thickness) of a carriage of the printer, in other words, there is a demand that the inkjet printer is constructed in such a way that an ink tank which accommodates ink is not installed on the carriage. To this end, the ink tank needs to be provided outside of the carriage, e.g., on a frame of the printer, and the ink in the ink tank needs to be supplied, via an ink supply tube, to a recording head carried on the carriage.

In the thus constructed ink-jet printer which uses the ink supply tube for supplying the ink from the ink tank to the recording head, the air inevitably permeates through the tube and is consequently dissolved in the ink due to properties or characteristics of the material for constituting the tube. Accordingly, it is needed to perform a so-called air-purging operation. Described in detail, there is provided a storage chamber (accumulating chamber) on the upstream side of the recording head in which bubbles are separated and removed from the ink.

As a technique to remove the bubbles in the ink-jet printer which uses the ink supply tube, there is known an arrangement as disclosed in JP-A-2000-103084 (paragraphs [0026]-[311] and FIG. 1, in particular), for instance. In this arrangement, a manifold (functioning as the storage chamber) is provided above the recording head while an ink tank and a circulating pump are provided on a stationary-position side, and the circulating pump is driven to remove the bubbles.

In the arrangement disclosed in JP-A-2000-103084, however, the ink-jet printer inevitably tends to be large-sized and complicated since it is needed to provide a return tube through which the ink is returned from the circulating pump to the ink tank for circulation.

Further, there is known an arrangement as disclosed in JP-A-2002-240310 (paragraphs [0006]-[0018] and FIG. 5, in particular), for instance. In this arrangement, the air separated as the bubbles in the ink supply tube is accumulated at an upper portion of the ink tank installed on the carriage and is discharged by a discharge pump. After the discharge of the air, the ink tank is fluid-tightly closed by an air-discharging valve.

The applicant of this application made an extensive study to meet a demand for simplification of a structure of an air-discharging valve for discharging the air in the ink-jet printer. As a result of the study, the applicant developed an air-discharging valve device. In the developed air-discharging valve device, a valve member is provided in an air-discharge hole that is a part of an air-discharge passage communicating with a storage chamber, such that the valve member is moved in an axis direction of the air-discharge hole by an operating member for thereby opening and closing the air-discharge passage. Thus, the developed device enables the bubbles in the storage chamber to be easily discharged.

For removing the bubbles in such an air-discharging valve device, it is required, for instance, that the valve member is moved along the axis direction of the air-discharge hole when the recording head is located at a maintenance position which is outside of a recording region where the recording head performs recording.

Accordingly, the following arrangement may be considered: At the maintenance position, the air-discharge hole is closed or capped at its open end by a cap member. For performing the air-purging operation, at the same time when the open end of the air-discharge hole is capped by the cap member, the valve member is moved by an operating member provided on the cap member and having an operating portion for moving the valve member, whereby the air-discharging valve device is placed in a valve-open state.

SUMMARY OF THE INVENTION

In the arrangement described above, when the carriage which carries the recording head is moved to the maintenance position, the operating portion of the operating member disposed at the maintenance position needs to be inserted into the air-discharge hole with the operating portion being positioned relative to the open end of the air-discharge hole. However, this positioning is rather difficult. In other words, the carriage which is moved from the recording region needs to stop at the maintenance position with a high degree of accuracy, such that the open end of the air-discharge hole and the operating portion of the operating member are positioned relative to each other.

In the meantime, in the above-described arrangement wherein the valve member is moved by the operating member, when the valve member is moved to place the air-discharging valve device in the valve-open state and the bubbles in the buffer tank is discharged, a part of the ink which is discharged together with the bubbles may remain in the air-discharging valve device or in the vicinity of the operating member which operates the air-discharging valve device. Such remaining ink may drop on the recording medium during the movement of the recording head or during the recording operation by the recording head.

It is therefore a fist object of the present invention to provide an ink-jet printer which can place an air-discharging valve device in a valve-open state with high reliability even where a carriage does not stop at a predetermined position with high accuracy. It is a second object of the invention to provide an ink-jet printer wherein an ink which remains in an air-discharging valve device as a result of an air-purging operation can be removed so as to avoid the reaming ink from dropping on a recording medium during a movement of a recording head or during a recording operation by the recording head.

The above-indicated first object of the invention may be achieved according to a first aspect of the present invention, which provides an ink-jet printer, comprising: a carriage which moves along a recording medium; a recording head which performs recording on the recording medium by ejecting ink from nozzle holes; an ink tank provided outside of the carriage; a buffer tank having a storage chamber which stores ink supplied from the ink tank; an air-discharge passage through which is discharged an air separated from the ink in the storage chamber; an air-discharging valve device which is provided for the air-discharge passage to open and close the air-discharge passage; a valve opening-and-closing device which is provided outside of the carriage and which operates the air-discharging valve device to be placed in a valve-open state and a valve-close state; and an operating member which is arranged to be interposed between the air-discharging valve device and the valve opening-and-closing device and which is moved by the valve opening-and-closing device, so that the air-discharging valve device is operated to be placed in the valve-open state and the valve-close state via the operating member, when the carriage is moved to a predetermined position.

In the ink-jet printer constructed according to the above-indicated first aspect of the invention, the operating member is arranged to be interposed between the air-discharging valve device and the valve opening-and-closing device. Therefore, by variously arranging the operating member, the ink-jet printer assures various advantages relating to a highly reliable operation of the air-discharging valve device by the operating member.

In a first preferred mode of the above-indicated first aspect of the invention, the operating member has a size larger than a size of an outlet of the air-discharge passage, as measured in a moving direction of the carriage.

Where the operating member has a size described above, the air-discharging valve device can be operated with high reliability by the valve opening-and-closing device via the operating member even if the accuracy with which the carriage stops at the predetermined portion is low.

In a second preferred mode of the above-indicated first aspect of the invention, the air-discharging valve device includes a valve member which is movable in a direction of extension of the air-discharge passage, and the operating member is arranged to be opposed to the valve member and movable in the direction of extension of the air-discharge passage so as to push the valve member, whereby the air-discharging valve device is operated to be placed in the valve-open state.

Where the operating member is arranged to be opposed to the valve member of the air-discharging valve device and movable in the direction of extension of the air-discharge passage as described above, the valve member is pushed by the movement of the operating member in that direction, thereby placing the air-discharging valve device in the valve-open state. Thus, the air-discharging valve device can be placed in the valve-open state and the valve-close state with a simple structure by combining the valve member which is movable in the direction of extension of the air-discharge passage and the operating member which is movable in that direction to push the valve member.

In a third preferred mode of the above-indicated first aspect of the invention, the operating member is provided on the carriage so as to be movable in a direction in which the air-discharging valve device is operated to be placed in the valve-open state and valve-close state, and the valve opening-and-closing device is opposed to the operating member when the carriage is moved to the predetermined position.

"The operating member is provided on the carriage" means that: (1) the operating member is provided on the carriage and moves together with the carriage; and (2) the operating member is in a state in which it can be movable at anytime.

Where the carriage is movably provided on the carnage as described above, the carriage and the operating member always move together and the operating member is in a state in which it can be moved irrespective of the location of the carriage. Further, when the carriage is moved to the predetermined position (e.g., a stand-by position or a maintenance position which is at the side of the recording area at which the recording is not performed), the operating member is moved by the valve opening-and-closing device, whereby the air-discharging valve device can be placed in the valve-open state with high reliability.

In other words, because the operating member is provided on the carriage, the air-discharging valve device can be placed in the valve-open state by simply moving the operating member owing to the operation of the valve opening-and-closing device. Therefore, it does not matter if the accuracy with which the carriage stops at the predetermined position is low, In one advantageous form of the above-indicated third preferred mode, a recess is formed at an end portion of a casing which partially constitutes the air-discharging valve device, and the operating member is movably accommodated in the recess. According to this arrangement, the operating member can be provided on the carriage with a simple structure.

Where the recess is formed alongside of a nozzle-opening surface of the recording head in which the nozzle holes are open, one surface of the operating member which is exposed from the recess is preferably substantially flush with the nozzle-opening surface of the recording head. According to this arrangement, the operating member and the recording medium do not interfere with each other during the movement of the carriage.

In another advantageous form of the above-indicated third preferred mode, a guide hole portion is provided in a casing which partially constitutes the air-discharging valve device and the operating member has an engaging portion which engages the guide hole portion so as to be movable in a direction of extension of the air-discharge passage. According to this arrangement, the operating member is moved in the direction of extension of the air-discharge passage while being guided owing to the engagement of the guide hole portion and the engaging portion. Therefore, the operating member is prevented from inclining during the movement thereof, whereby it is avoidable that that amount of movement of the valve member required for placing the air-discharging valve device in the valve-open state becomes insufficient due to inclination of the operating member.

In a fourth preferred mode of the above-indicated first aspect of the invention, the operating member is connected to an end of the valve opening-and-closing device, which end is near to the air-discharging valve device, and the valve opening-and-closing device is opposed to the air-discharging valve device via the operating member when the carriage is moved to the predetermined position.

According to the above-indicated fourth preferred mode, the air-discharging valve device can be operated, with high reliability, by the valve opening-and-closing device via the operating member, when the carriage is moved to the predetermined position.

In a fifth preferred mode of the above-indicated first aspect of the invention, (A) the ink tank is provided in a plural number to give a plurality of ink tanks, the storage chamber of the buffer tank is provided in the plural number to give a plurality of storage chambers that respectively correspond to a plurality of inks supplied from the plurality of ink tanks, the air-discharge passage is provided in the plural number to give a plurality of air-discharge passages that respectively correspond to the plurality of storage chambers, and the air-discharging valve device is provided in the plural number so as to give a plurality of air-discharging valve devices that respectively correspond to the plurality of air-discharge passages, and (B) the operating member is arranged to be located so as to be opposed to at least two of the plurality of air-discharging valve devices, so that, when the carriage is moved to the predetermined position, the valve opening-and-closing device moves the operating member such that the at least two of the plurality of air-discharging valve devices are simultaneously operated.

According to the above-indicated fifth preferred mode, the storage chambers, the air-discharge passages, and the air-discharging valve devices are provided for the respective inks in an ink-jet printer using a plurality of inks (e.g., an ink-jet printer capable of performing multi-color recording), so that the air can be discharged without suffering from mixing of inks of different colors. Further, because the operating member is arranged to correspond to the at least two of the plurality of air-discharging valve devices, the structure of the valve opening-and-closing device for operating the at least two air-discharging valve devices can be simplified. In addition, the at least two air-discharging valve devices can be operated simultaneously.

In the above-indicated fifth preferred mode of the first aspect of the invention, the operating member may be provided to correspond to all of the plurality of air-discharging valve devices, or the operating member may be provided to correspond to a part of the plurality of air-discharging valve devices and the ink-jet printer may further comprise another operating member which corresponds to the rest of the plurality of air-discharging valve devices.

In a six preferred mode of the above-indicated first aspect of the invention, the ink-jet printer may further comprise an exhaust device which is provided outside of the carriage and is connectable to the air-discharge passage when the carriage is moved to the predetermined position.

In the above-indicated six preferred mode, when the carriage is moved to the predetermined position, the air-discharging valve device is operated by the operating member and the air can be discharged by the exhaust device connected to the air-discharge passage.

In a seventh preferred mode of the above-indicated first aspect of the invention, (A) the ink tank is provided in a plural number to give a plurality of ink tanks, the storage chamber of the buffer tank is provided in the plural number to give a plurality of storage chambers that respectively correspond to a plurality of inks supplied from the plurality of ink tanks, the air-discharge passage is provided in the plural number to give a plurality of air-discharge passages that respectively correspond to the plurality of storage chambers, and the air-discharging valve device is provided in the plural number to give a plurality of air-discharging valve devices that respectively correspond to the plurality of air-discharge passages, (B) the operating member is movably provided on the carriage for simultaneously operating at least two of the plurality of air-discharging valve devices, and (C) the operating member is moved by the valve opening-and-closing device such that the at least two of the plurality of air-discharging valve devices are simultaneously operated, when the carriage is moved to the predetermined position.

The above-indicted seventh preferred mode is a particularly effective mode of the first aspect of the invention described above. The seventh preferred mode enjoys the advantages described above with respect to the operating member which is movably provided on the carriage and which is arranged to simultaneously operate the at least two of the plurality of air-discharging valve devices. This seventh preferred mode may employ various technical features explained in the preferred modes and arrangements described above.

The above-indicated second object of the invention may be attained according to a second aspect of the invention, which provides an ink-jet printer comprising; a recording head which performs recording on a recording medium by ejecting ink from nozzle holes; an ink tank for storing ink to be supplied to the recording head; a buffer tank for storing the ink supplied from the ink tank; and an air-discharging valve device which discharges an air separated from the ink in the buffer tank through an air-discharge passage, wherein the ink-jet printer is arranged to execute: a first discharge operation in which the air separated from the ink in the buffer tank is discharged through the air-discharge passage while fluid-tightly closing an outer space outside of an outlet of the air-discharging valve device and placing the air-discharging valve device in a valve-open state; and a second discharge operation in which an inside of the air-discharging valve device is exhausted together with an atmosphere introduced into the outer space while placing the air-discharging valve in a valve-close state.

In the ink-jet printer constructed according to the above-indicated second aspect of the invention, in addition to the first discharge operation for removing the bubbles in the buffer tank, the second discharge operation is executed for removing the ink which remains in the air-discharging valve device after the first discharge operation has been executed. Described more specifically, when the recording head is moved to a position other than a recording area at which the recording is performed by the recording head, the first discharge operation is executed in which the air separated from the ink in the buffer tank is discharged through the air-discharge passage while fluid-tightly closing the outer space and placing the air-discharging valve device in the valve-open state. Then, the second discharge operation is executed in which the inside of the air-discharging valve device is exhausted together with the atmosphere introduced into the outer space while placing the air-discharging valve device in the valve-close state. Thus, the ink remaining in the air-discharging valve device is removed by sucking.

Therefore, even if the ink remains in the air-discharging valve device due to the first discharge operation, the remaining ink can be removed by the second discharge operation, whereby the remaining ink is prevented from dropping on the recording medium during the movement of the recording head or during the recording operation carried out by the recording head.

In a first preferred form of the above-indicated second aspect of the invention, the ink-jet printer further comprises: a maintenance unit which executes the first discharge operation; and a control device which controls the maintenance unit to execute the second discharge operation after the first discharge operation.

According to the above-indicated first preferred form, the maintenance unit is controlled to execute the first discharge operation and the second discharge operation in common. Described more specifically, after the first discharge operation has been executed by the maintenance unit to discharge the separated air, the control device controls the maintenance unit to exhaust the inside of the air-discharging valve device, together with the introduced atmosphere. Therefore, the remaining ink in the inside of the air-discharging valve device which is attributable to the first discharge operation can be removed utilizing the maintenance unit that executes the first discharge operation.

In a second preferred mode of the above-indicated second aspect of the invention, the ink-jet printer further comprises:

a valve opening-and-closing device for placing the air-discharging valve device in the valve-open state and the valve-close state;

a cap member which can fluid-tightly close the outer space;

a first moving device which moves the cap member between a first position at which the cap member is advanced to fluid-tightly close the outer space of the air-discharging device and a second position at which the cap member is retracted from the first position to release the fluid-tight closing by the cap member;

a suction pump which is connected to the cap member; and a control device which controls the valve opening-and-closing device, the first moving device, and the suction pump and which executes, when the recording head is moved to a stand-by position at which the recording head does not perform the recording, (a) a first-discharge-operation control for controlling the first discharge operation in which the first moving device is controlled to move the cap member to the first position, the valve opening-and-closing device is controlled to place the air-discharging valve device in the valve-open state, and the suction pump is controlled to discharge the air separated from the ink in the buffer tank through the air-discharge passage, and (b) a second-discharge-operation control for controlling the second discharge operation in which the valve opening-and-closing device is controlled to place the air-discharging valve device in the valve-close state, an atmosphere-introduction state is realized for introducing an atmosphere into the outer space, and the suction pump is controlled to exhaust the inside of the air-discharging valve device together with the atmosphere introduced into the outer space.

According to the above-indicated second preferred mode, the control device executes the first discharge-operation control for controlling the first discharge operation. By the execution of the first-discharge-control, the first discharge operation is executed. Described in detail, when the recording head is moved to the stand-by position at which the recording operation is not performed, the cap member is moved to the first position at which the outer space located outside of the outlet of the air-discharging valve device is fluid-tightly closed. With the outer space being fluid-tightly closed, the air-discharging valve device is placed in the valve-open state and the air separated from the ink in the buffer tank is discharged by the suction pump through the air-discharge passage. Thus, the first discharge operation is executed. Thereafter, the control device executes the second-discharge-operation control for controlling the second discharge operation. By execution of the second-discharge-operation control, the second discharge operation is executed. Described in detail, the air-discharging valve device is placed in the valve-close state, and the inside of the air-discharging valve device is exhausted by the suction pump, together with the introduced atmosphere. Thus, the second discharge operation is executed, so that the ink remaining in the air-discharging valve device due to the first discharge operation is removed therefrom.

In a first advantageous form of the above-indicated second preferred mode, an atmosphere communication opening is formed in a casing that partially constitutes the air-discharging valve device, and the atmosphere communication opening is arranged to be closed at the time of execution of the first discharge operation and opened at the time of execution of the second-discharge operation for introducing the atmosphere into the outer space.

According to the above-indicated first advantageous form, the atmosphere can be easily introduced through the atmosphere communication hole at the time of execution of the second discharge operation.

Preferably, the atmosphere communication hole is closed in the valve-open state of the air-discharging valve device and opened in the valve-close state thereof, by an operation of the valve opening-and-closing device. In this arrangement, the opening and closing of the atmosphere communication opening in the first and second discharge operations can be carried out easily.

In a second advantageous form of the above-indicated second preferred mode, when the second discharge operation is executed, the control device controls the first moving device to move the cap member to a third position at which the cap member is retracted from the first position to slightly release the fluid-tight closing by the cap member for introducing the atmosphere into the outer space.

According to the above-indicated second advantageous form, it is necessary to form, in the casing, an atmosphere communication opening or the like for introducing the atmosphere.

In a third advantageous form of the above-indicated second preferred mode, (A) the buffer tank has a plurality of storage chambers which respectively store a plurality of inks, and the air-discharge passage and the air-discharging valve device are provided in a plural number to give a plurality of air-discharge passages and a plurality of air-discharging valve devices corresponding to the plurality of storage chambers, (B) each of the plurality of air-discharging valve devices includes: a valve member which is moved in a direction of extension of the plurality of air-discharge passages, whereby each of the plurality of air-discharging valve devices is placed in the valve-open state and the valve-close state, (C) the ink-jet printer further comprises an operating member which is provided so as to correspond to at least two of the plurality of air-discharging valve devices, which has at least two operating portions each corresponding to each of the valve members of each of the at least two of the plurality of air-discharging valve devices, and which engages a casing that partially constitutes the at least two of the plurality of air-discharging valve devices, so as to be movable in the direction of extension of at least two of the plurality of air-discharge passages which correspond to the at least two of the plurality of air-discharging valve devices, (D) the valve opening-and-closing device includes a second moving device having a movable member by which the operating member is moved in the direction of extension of the at least two of the plurality of air-discharge passages, (E) the cap member is located on the downstream side of the operating member as viewed in the direction of extension of the at least two of the plurality of air-discharge passages when the cap member is in the first position, and (F) the second discharge operation is executed such that a space located around the operating member is also exhausted.

The above-indicated third advantageous form is an effective form of the second aspect of the invention where the ink-jet printer performs the recording operation using a plurality of inks. It is noted that "a space located around the operating member" may be interpreted that the space is included in the outer space indicated above. According to the third advantageous form, the operating member is moved in the direction of extension of the at least two of the plurality of air-discharge passages by the movable member of the second moving device, whereby the at least two of the air-discharging valve devices can be simultaneously opened and closed with ease. Moreover, by the execution of the second discharge operation, the inside in the at least two air-discharging valve devices and the space around the operating member are exhausted, so that the ink remaining in the inside of the at least two air-discharging valve devices and on the operating member can be removed.

In the third advantageous form described above, the casing preferably has a guide hole portion and the operating member preferably has an engaging portion which slidably engages the guide hole portion. In this arrangement, the engaging portion of the operating member slidably engages the guide hole portion of the casing, whereby the operating member is moved while being guided owing to the engagement of the engaging portion and the guide hole portion. Hence, the at least two air-discharging valve devices can be smoothly placed in the valve-open state and the valve-close state.

Preferably, the engaging portion is disposed at a middle of the operating member. In this arrangement, because the engaging portion which guides the movement of the operating member is disposed at a middle of the operating member, the operating member is prevented from inclining during the movement thereof.

Preferably, the guide hole portion is formed with an atmosphere communication hole which is arranged to be closed at the time of execution of the first discharge operation and opened at the time of execution of the second discharge operation for introducing the atmosphere into the outer space. In this arrangement, because the atmosphere communication hole that is arranged to be closed at the time of execution of the first discharge operation is formed in the guide hole portion, the atmosphere can be easily introduced through the atmosphere communication hole at the time of execution of the second discharge operation, without influencing the first discharge operation.

Preferably, the atmosphere communication hole is closed in the valve-open state of the at least two of the plurality of air-discharging valve devices and opened in the valve-close state thereof by an operation of the valve opening-and-closing device. In this arrangement, the atmosphere communication hole can be easily opened and closed.

In the above-indicated third advantageous form, the operating member is preferably provided to correspond to all of the plurality of air-discharging valve devices and preferably has a plurality of operating portions that respectively correspond to the valve members of the plurality of air-discharging valve devices. In this arrangement, all of the plurality of air-discharging devices can be easily operated.

In the above-indicated third advantageous form, the operating member is preferably provided to correspond to a part of the plurality of air-discharging valve devices, and the ink-jet printer preferably further comprises another operating member which corresponds to the rest of the plurality of air-discharging valve devices and which has operating portions that respectively correspond to the valve members of the rest of the plurality of air-discharging valve devices. In this instance, the above-indicated another operating member is not necessarily moved by the movable member of the moving device, but may be moved directly by the moving device. In this arrangement, the plurality of air-discharging devices may be divided into groups, i.e., the part of the plurality of air-discharging valve devices and the rest of the plurality of air-discharging valve devices, and the first and second discharge operations can be executed in an optimum manner for each of the groups of the air-discharging valve devices by taking into account a difference between the resistance of flow of the inks flowing in the part of the air-discharging valve devices in one group and the resistance of flow of the ink(s) flowing in the rest of the air-discharging valve device(s) in another group.

In a third preferred form of the above-indicated first aspect of the invention, the ink-jet printer further comprises:

a valve opening-and-closing device for placing the air-discharging valve device in the valve-open state and the valve-close state;

a cap member which can fluid-tightly close the outer space;

a first moving device which moves the cap member between a first position at which the cap member is advanced to fluid-tightly closes the outer space and a second position at which the cap member is retracted from the first position to release the fluid-tight closing by the cap member;

a suction pump which is connected to the cap member; and a control device which controls the valve opening-and-closing device, the first moving device, and the suction pump and which executes, when the recording head is moved to a stand-by position at which the recording head does not perform the recording, (a) a first-discharge-operation control for controlling the first discharge operation in which the first moving device is controlled to move the cap member to the first position, the valve opening-and-closing device is controlled to place the air-discharging valve device in the valve-open state, and the suction pump is controlled to discharge the air separated from the ink in the buffer tank through the air-discharge passage, and (b) a second-discharge-operation control for controlling the second discharge operation in which an atmosphere-introduction state is realized for introducing an atmosphere into the outer space, with the cap member positioned such that the fluid-tight closing by the cap member is slightly released, and the suction pump is controlled to exhaust the inside of the air-discharging valve device together with the atmosphere introduced into the outer space.

The above-described third preferred mode is an effective mode of the second aspect of the invention. In this third preferred mode, the second operation is executed with the cap member positioned such that the fluid-tight closing by the cap member is slightly released. Therefore, the casing need not be provided with an atmosphere communication opening or the like for introducing the atmosphere.

The present invention may be practiced by combining the technical features according to the above-indicated first aspect and the technical features according to the above-indicated second aspect.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which:

FIGS. 7A-7B are views for explaining a valve member, in which FIG. 7A is a front elevational view partly in cross section and FIG. 7B is a bottom plan view;

DETAILED DESCRIPTION OF THE PREFERRED EMBODIMENTS

There will be described in detail preferred embodiments of the present invention by reference to the accompanying drawings.

Figure 1:
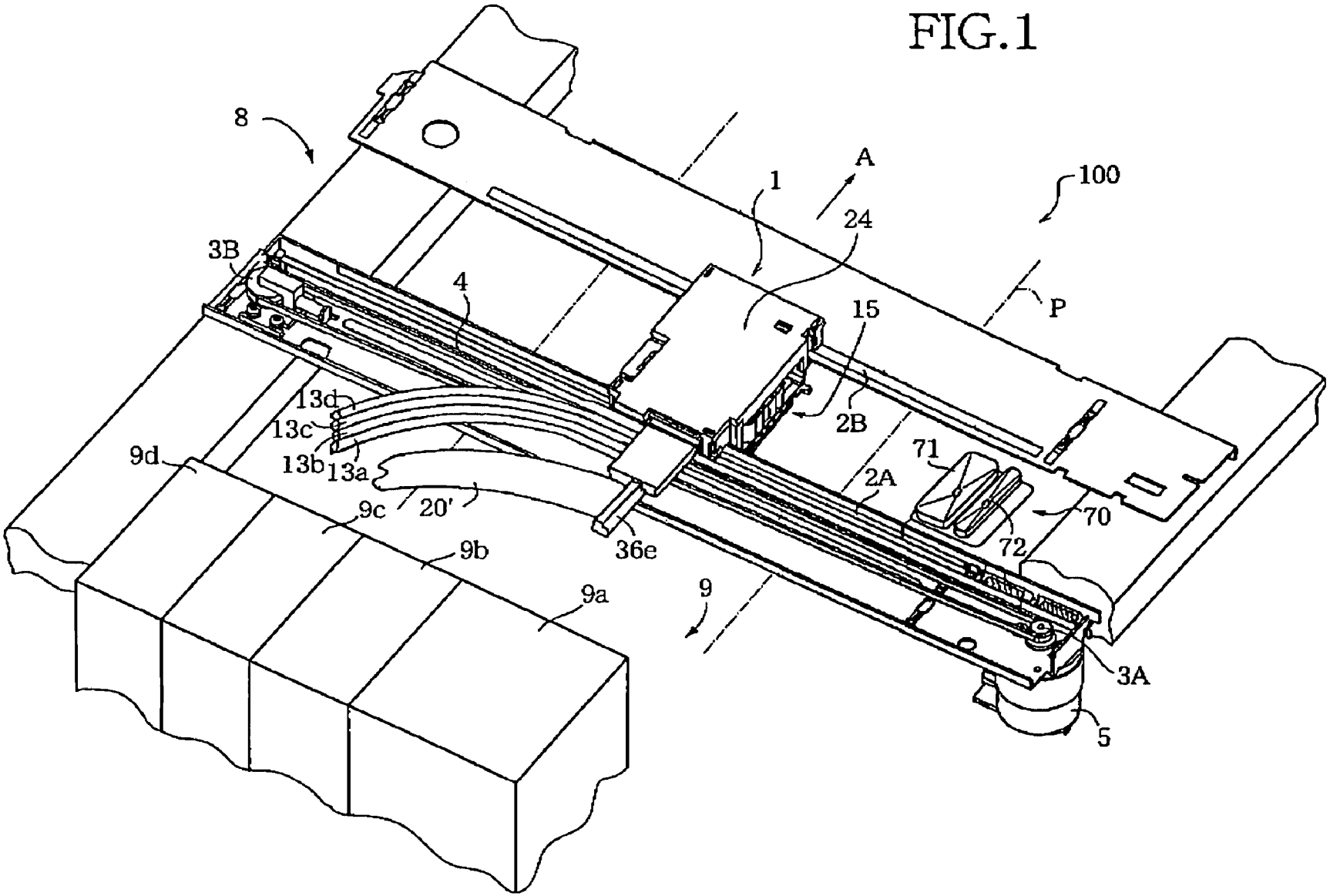
FIG. 1 is a schematic view showing principal parts of an ink-jet printer to which the principle of the present invention is applied.
Figure 2:
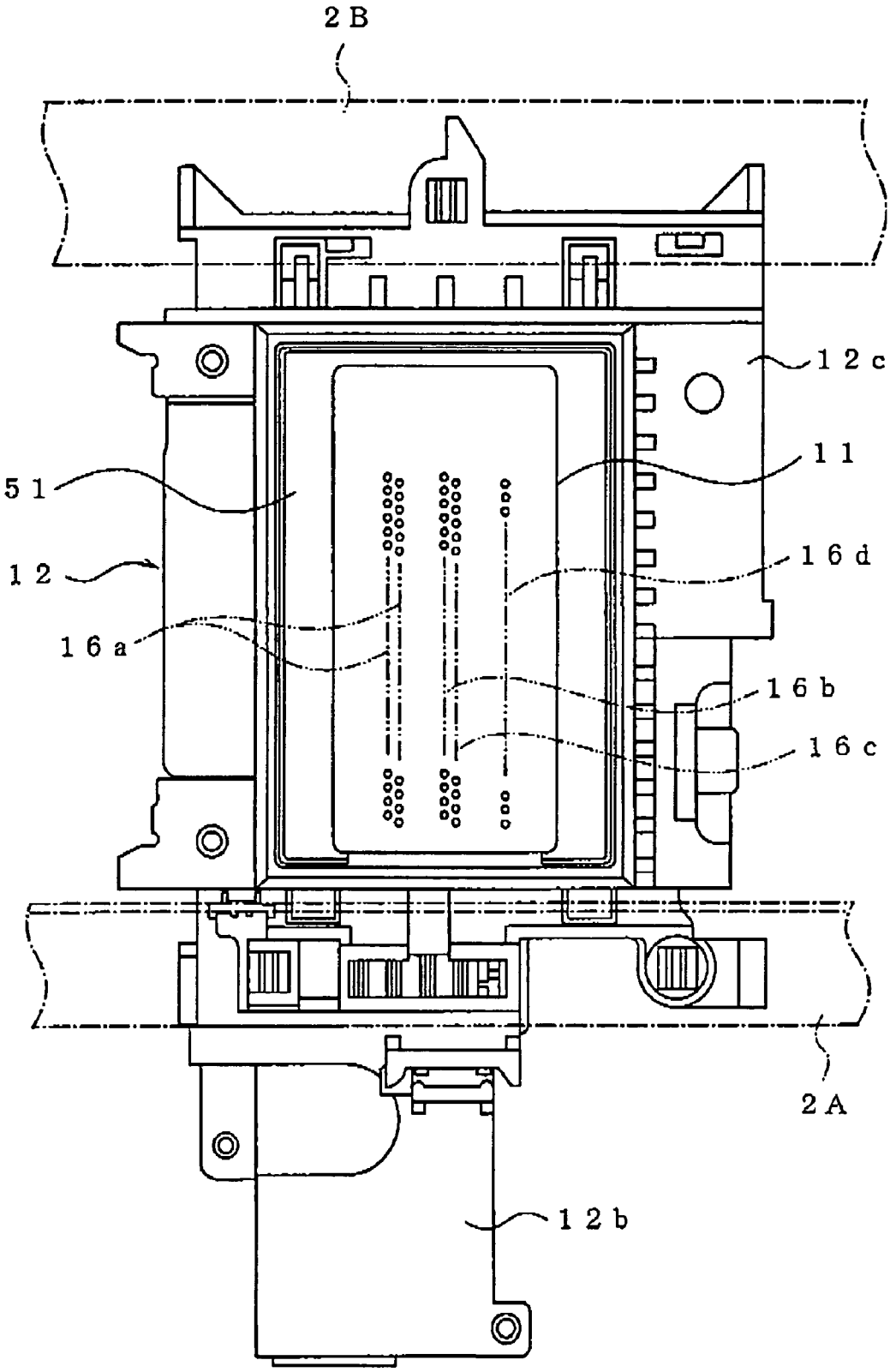
FIG. 2 is a bottom plan view of an ink-jet recording unit of the printer of FIG. 1.
Figure 3:
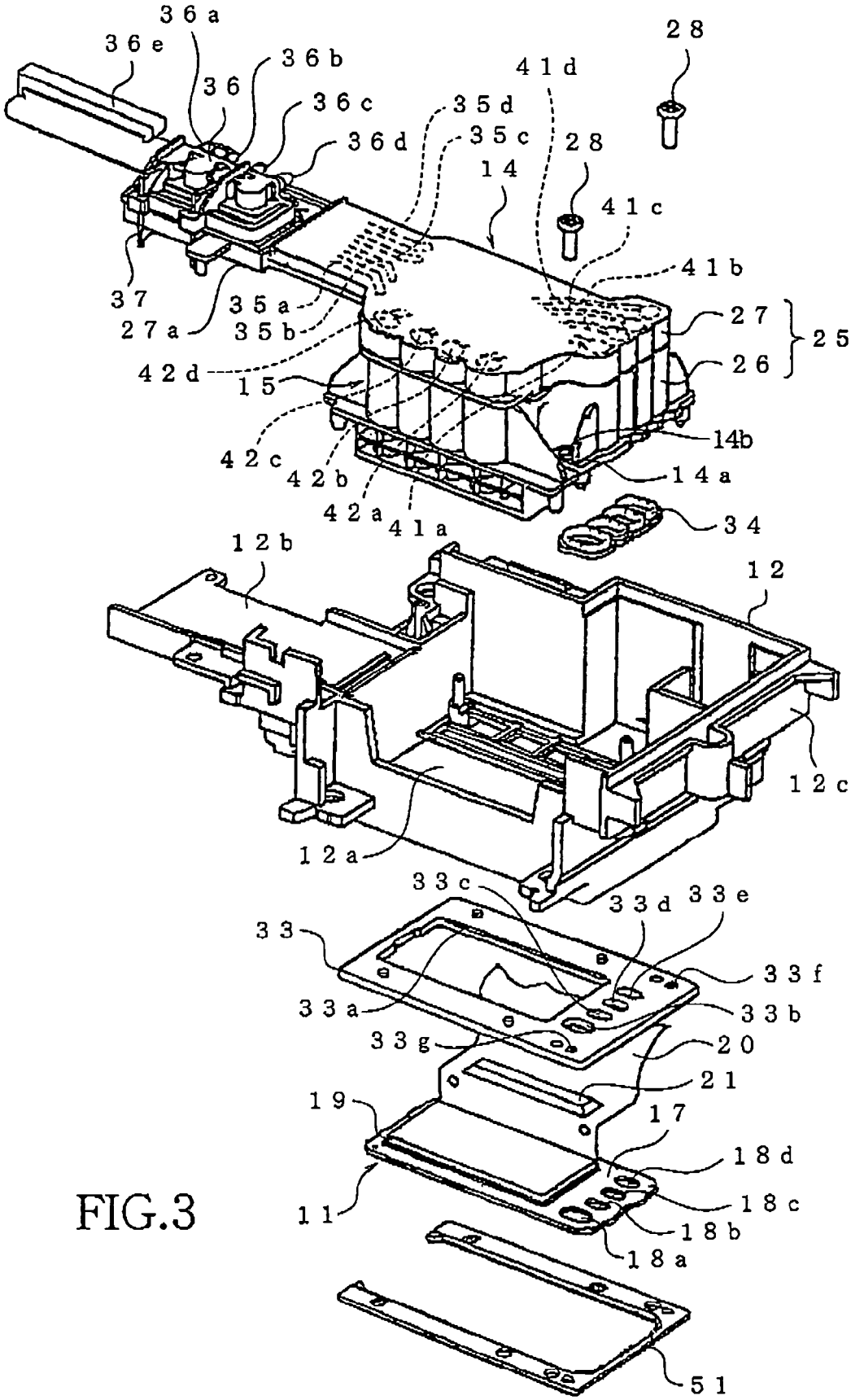
FIG. 3 is an exploded perspective view of the ink-jet recording unit including a recording head, a reinforcement frame member, a carriage, and a buffer tank.

FIG. 1 is a schematic view showing principal parts of an ink-jet printer 100 to which the principle of the present invention is applied. FIG. 2 is a bottom plan view of an ink-jet recording unit 1 of the printer 100. FIG. 3 is an exploded perspective view of the ink-jet recording unit 1 which includes a recording head 11, a reinforcement frame member 33, a carriage 12, and a buffer tank 14.

As shown in FIGS. 1-3, the ink-jet printer 100 includes the ink-jet recording unit 1 having a thin plate-stacked recording head 11 of an ink-jet type for ejecting inks from nozzle holes to perform recording on a paper sheet P as a recording medium, and a carriage 12 on which the recording head 11 is mounted and which is formed of a synthetic resin material. The carriage 12 moves relative to the paper sheet P. The ink-jet printer 100 further includes an ink tank 9 provided outside of the carriage 12. Described more specifically, the ink tank 9 includes a plurality of ink tanks 9*a*-9*d* respectively for a black ink, a cyan ink, a magenta ink, and a yellow ink, which are provided on a frame 8 (a part of which is shown in FIG. 1) of the printer for performing full-color printing or recording. In the present inkjet printer 100, the inks of the plurality of colors are supplied from the respective ink tanks 9*a*-9*d* via respective ink supply tubes 13*a*-13*d* (as a part of ink passages) to the buffer tank 14 that is mounted on the carriage 12 and temporarily stored in the buffer tank 14 independently of one another. Then, the inks are supplied to the recording head 11. The ink tanks 9*a*-9*d* are removably attached to the frame 8 of the printer (hereinafter may be referred to as "the printer frame 8") and store a large volume of the inks to be supplied to the recording head 11.

The carriage 12 is slidably supported by a rear guide member ZA and a front guide member 2B which are parallel to each other in a frontward and backward direction of the frame 8 of the printer 100 and which extend in a leftward and rightward direction of the frame 8. The rear guide member 2A has a generally "L"-shape in cross section in a plane perpendicular to a sliding or moving direction of the carriage 12 in which the carriage 12 slides or moves. The front guide member 2B has a horizontal plane extending in the sliding direction. The carriage 12 is connected to a portion of an endless timing belt 4 stretched between a drive pulley 3A and a driven pulley 3B. By driving the drive pulley 3A by a drive motor 5, the carriage 12 is arranged to be reciprocated in the leftward and rightward direction of the frame 8 via the timing belt 4 along the rear and front guide members 2A, 2B. The upper portion of the carriage 12 is covered with a cover 24. Although not specifically shown, a known sheet feeding mechanism is provided to feed the paper sheet P in a direction (indicated by an arrow "A" in FIG. 1) perpendicular to the moving direction (scanning direction) of the carriage 12, such that the paper sheet P faces the lower surface of the recording head 11 in a state in which recording can be performed on the paper sheet P. There are also provided a maintenance unit 70 (which will be described in greater detail) which performs a cleaning operation for cleaning a nozzle-opening surface of the recording head 11 in which the nozzle holes are formed, a restoring treatment in which a selected one or ones of different colors of inks is/are sucked, and a bubble (air) removal treatment for removing bubbles (air) accumulated in the buffer tank 14, and an ink-receiving portion (not shown) which receives inks ejected from the recording head 11 in a flushing operation periodically performed during the recording operation for preventing clogging of the nozzle holes.

As shown in FIG. 2 indicating the lower or bottom surface of the recording head 11, there are formed, in the lower surface of the recording head 11, two rows of black-ink (BK) nozzle holes 16*a*, a row of cyan-ink (C) nozzle holes 16*b*, a row of a yellow-ink (Y) nozzle holes 16*c*, and a row of the magenta-ink (A) nozzle holes 16*d*, which rows are arranged in order from the left to the right as seen in the bottom plan view of the recording head 11 of FIG. 2. These rows of the nozzle holes 16*a*-16*d* extend in a direction perpendicular to the moving direction (the scanning direction) of the carriage 12. The nozzle holes 16*a*-16*d* are formed in the lower surface of the recording head 11 so as to be open downwardly, such that the nozzle holes 16*a*-16*d* are opposed to the upper surface of the paper sheet P on which the recording is performed.

As shown in FIG. 3, at one of longitudinally opposite ends of the recording head 11, four ink supply holes 18*a*-18*d* of a cavity unit 17 respectively for the inks of four different colors are formed in a row so as to be open in the upper surface of the recording head 11. The inks are distributed via respective ink supply channels extending from the respective ink supply holes 18*a*-18*d*, and are ejected from the nozzle holes 16*a*-16*d* by driving a piezoelectric actuator 19. The area of opening of the ink supply hole 18*a* for the black ink (BK) is made larger than that of the other ink supply holes 18*b*-18*d* for the cyan ink (C), the yellow ink (Y), and the magenta ink (M), respectively.

In the recording head 11, the piezoelectric actuator 19 has an outer contour in its plan view which is smaller than that of the cavity unit 17, so that, when the piezoelectric actuator 19 is superposed or stacked on the upper surface of the cavity unit 17, the peripheral portion of the upper surface of the cavity unit 17 which surrounds the piezoelectric actuator 19 and which includes the ink supply holes 18*a*-18*d* is exposed on the upper surface of the recording head 11.

On the upper surface of the piezoelectric actuator 19, a flexible flat cable 20 is fixed at its proximal portion for applying a voltage to the piezoelectric actuator 19. The flexible flat cable 20 has a driver IC 21 and is electrically connected to a printed board 22 (FIG. 5) disposed on the buffer tank 14. The printed board 22 is arranged to be connected to a printed board (not shown) provided on the printer frame side (8) of the ink-jet printer 100 via another flexible flat cable 20'. Because the driver IC 21 generates a heat, a heat sink 23 formed of an aluminum alloy is disposed so as to be held in pressing contact with the driver IC 21 as shown in FIG. 6 for cooling the same 21, so that the driver IC 21 is spontaneously cooled down through the heat sink 23.

Figure 4:
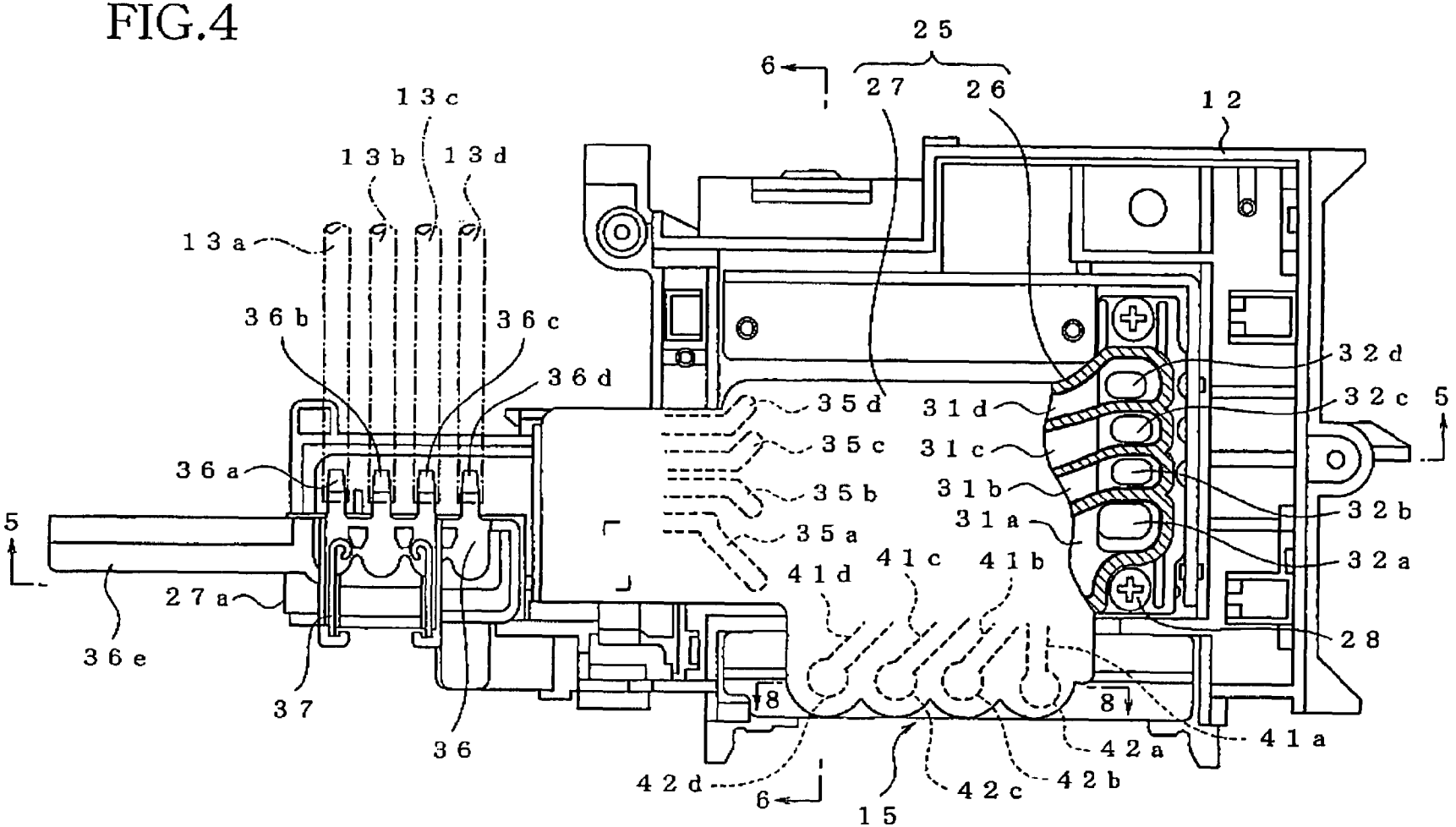
FIG. 4 is a plan view partly in cross section showing the ink-jet recording unit of FIG. 2.
Figure 5:
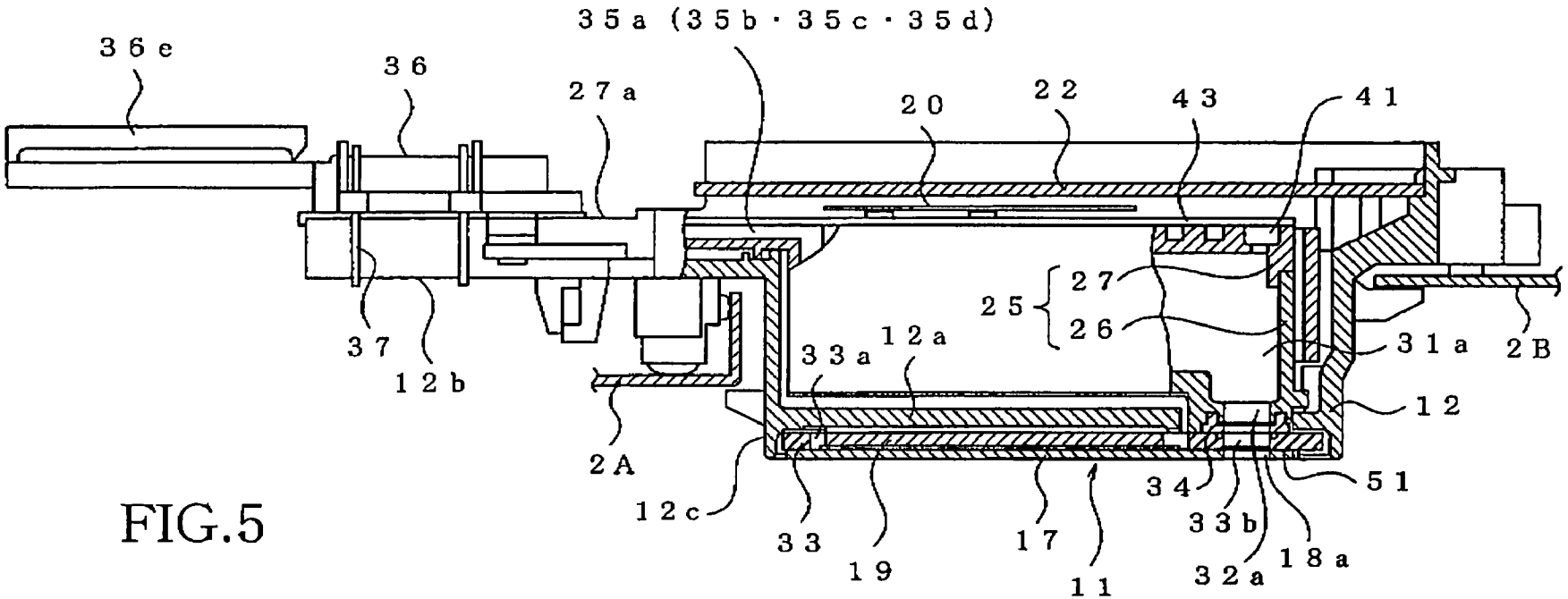
FIG. 5 is a cross sectional view taken along line 5-5 in FIG. 4.
Figure 6:
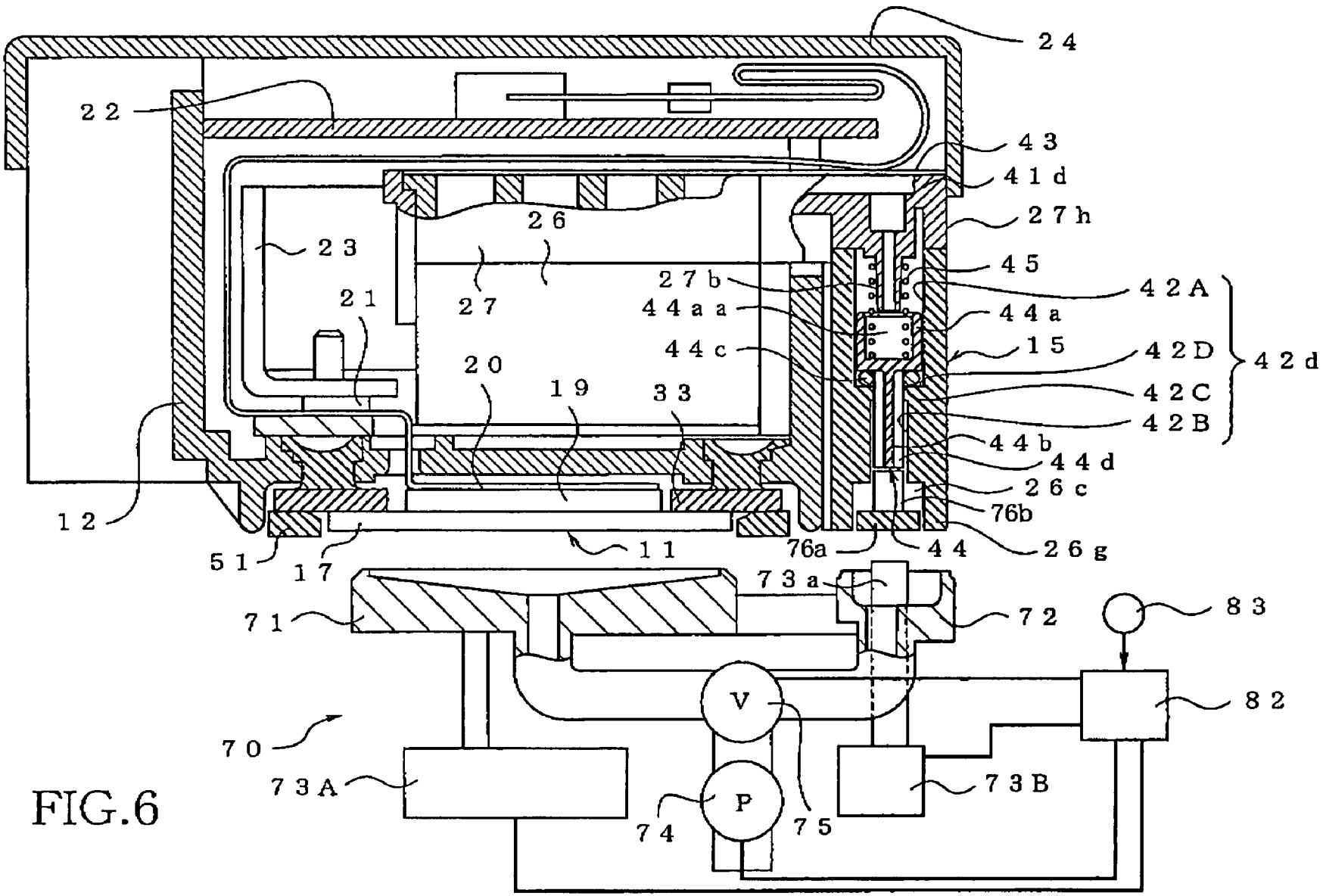
FIG. 6 is a cross sectional view taken along line 6-6 in FIG. 4 and for explaining an air-discharging valve device according to a first embodiment of the invention.

As shown in FIGS. 4-6, there are provided, in the buffer tank 14, a plurality of mutually independent storage chambers for the respective inks of different colors, which chambers are formed by providing partition walls in an inside space of a case body 25. More specifically described, the plurality of storage chambers consist of four storage chambers 31*a*-31*d* respectively for the black ink (BK), the cyan ink (C), the yellow ink (Y), and the magenta ink (M).

The case body 25 in which the buffer tank 14 is formed is constituted by a box-like lower casing member 26 having an upper opening, and an upper casing member 27 which is fixed to the lower casing member 26 so as to close the upper opening of the lower casing member 26. The lower and upper casing members 26, 27 are both formed by injection molding of a synthetic resin material and fluid-tightly fixed to each other by ultrasonic welding, for instance. The thus fixed lower and upper casing members 26, 27 define the storage chambers 31*a*-31*d*. Each storage chamber 31*a*-31*d* may be given by a single space or a plurality of divided spaces. Each of the storage chambers 31*a*-31*d* communicates at one end thereof with a corresponding one of ink outlets 32*a*-32*d* for the respective inks.

The carriage 12 has a bottom plate portion 12*a* which is generally parallel to the upper surface of the recording head 11. The recording head 11 is bonded to the lower surface of the bottom plate portion 12*a* with the reinforcement frame member 33 interposed therebetween. The reinforcement frame member 33 will be described. As shown in FIG. 3, on the upper side of the bottom plate portion 12*a* of carriage 12, there is disposed the case body 25 which includes the buffer tank 14 for temporarily storing the inks therein and a plurality of air-discharging devices 15 respectively for discharging the air accumulated in the respective storage chambers 31*a*-31*d* of the buffer tank 14.

The ink outlets 32*a*-32*d* are arranged in a row on the lower surface of the lower casing member 26 so as to be open downwardly and located at a height position lower than that of the bottom plate portion 12*a* of the carriage 12. The cavity unit 17 (the recording head 11) has, on the upper surface thereof, the plurality of ink supply holes 18*a*-18*d* each communicating with one end of a corresponding one of the ink supply channels (manifolds) formed in the inside of the cavity unit 17 for the respective inks of the different colors, such that the ink supply holes 18*a*-18*d* respectively correspond to the ink outlets 32*a*-32*d*. The ink outlets 32*a*-32*d* are held in communication with the respective ink supply holes 18*a*-18*d* of the cavity unit 17 (the recording head 11) through respective ink passage holes 33*b*-33*e* formed in a row through the reinforcement frame member 33, via an elastic sealing member 34 such as a rubber packing.

The recording head 11 is fixed to the lower side of the carriage 12 with the reinforcement frame member 33 interposed therebetween. As shown in FIG. 3, the reinforcement frame member 33 has a flat plate-like member along the upper surface of the recoding head 11 and has a central opening 33*a* whose size in plan view is slightly larger than that of the outer contour of the piezoelectric actuator 19 and smaller than that of the outer contour of the cavity unit 17. Accordingly, the reinforcement frame member 33 is bonded and fixed to the upper surface of the cavity unit 17 such that the piezoelectric actuator 19 and the flexible flat cable 20 are positioned or fitted in the central opening 33*a*.

The reinforcement frame member 33 is formed of a metal such as SUS430 and has a thickness and a rigidity which are larger and higher than those of the cavity unit 17. As described above, the reinforcement frame member 33 has, at its longitudinal end corresponding to the ink supply holes 18*a*-18*d* of the cavity unit 17, the four ink passage holes 33*b*-33*e* formed therethrough in a row for connecting the ink outlets 32*a*-32*d* of the buffer tank 14 and the ink supply holes 18*a*-18*d* of the cavity unit 17.

To compensate for a difference in height positions between the lower surface of the recording head 11 and the reinforcement frame member 33 and to protect the recording head 11, a protective cover 51 having a generally U-shape in plan view is attached to the reinforcement frame member 33 so as to surround the periphery of the recording head 11.

As shown in FIG. 3, the reinforcement frame member 33 has tapped or threaded holes 33*t*, 33*g* formed at two corner portions thereof The buffer tank 14 is provided with flange-like fixing portions 14*a* which protrude outwardly from its periphery so as to correspond to the tapped holes 33*f*, 33*g*. The fixing portions 14*a* are formed with through-holes 14*b*. Two screws 28 each as a fastening member are respectively screwed into the tapped holes 33*t* 33*g* via the through-holes 14*b*, whereby the buffer tank 14 is fixed to the reinforcement frame member 33 which is bonded and fixed to the lower surface of the bottom plate portion 12*a* of the carriage 12.

On one of opposite ends of the upper casing member 27 of the case body 25 remote from the ink outlets 32*a*-32*d*, there is provided a flange-like extended portion 27*a* which extends therefrom and in which are formed mutually independent four ink-inlet passages 35*a*-35*d* respectively for the black ink (BYK), the cyan ink (C), the yellow ink CY), and the magenta ink (M), as shown in FIGS. 3 and 4. The downstream ends of the respective ink-inlet passages 35*a*-35*d* are held in communication with the respective storage chambers 31*a*-31*d*. On the lower side of the extended portion 27*a* of the upper casing member 27, an extended portion 12*b* of the carriage 12 is formed so as to correspond to the extended portion 27*a*. The extended portion 12*b* of the carriage 12 extends from an upper end of a box-like main body 12*c* of the carriage 12 in which the buffer tank 14 is accommodated, so as to correspond to the extended portion 27*a* of the upper casing member 27. To the leading ends of the extended portions 12*b*, 27*a*, a tube joint 36 having ink paths for the respective inks of the different colors is elastically attached by a spring 37. Thus, the ink-inlet passages 35*a*-35*d* communicate at upstream ends thereof with the respective ink paths within the tube joint 36.

The tube joint 36 has tube-connecting portions 36*a*-36*d* communicating with the respective ink paths within the same 36. To each of the tube-connecting portions 36*a*-36*d* of the tube joint 36, each of the ink supply tubes 13*a*-13*d* is removably connected at one end thereof opposite to the other end communicating with the corresponding ink tank (9*a*-9*d*). The tube joint 36 has an integrally formed holding portion 36*e* for holding the flexible flat cable 20' which connects the printed board 22 to the printed board (not shown) provided on the printer frame side (8).

On the upper surface side of the upper casing member 27, there are formed mutually independent four discharge-air introducing passages 41*a*-41*d* for the respective inks of the four different colors. Each of the discharge-air introducing passages 41*a*-41*d* is in the form of a recess and communicates at one end thereof with an upper space of the corresponding storage chamber 31*a*-31*d*. Each discharge-air introducing passage 41*a*-41*d* extends along the upper surface of the upper casing member 27 and communicates at the other end thereof with a corresponding one of the air-discharging valve devices 15. The upper openings of the discharge-air introducing passages 41*a*-41*d* are covered with a flexible film 43.

Referring next to FIGS. 6-9, there will be explained in detail the air-discharging valve devices 15, constructed according to a first embodiment of the invention, for discharging the air separated from the ink in the storage chambers 31*a*-31*d* of the buffer tank 14 and introduced through the discharge-air introducing passages 41*a*-41*d*.

The plurality of air-discharging valve devices 15 have an outer contour that is provided by a casing common to all of the air-discharging valve devices. More specifically described, the casing is constituted by a lower valve casing portion 26*g* which is formed integrally on one side of the lower casing member 26 and an upper valve casing portion 27*h* which is formed integrally on one side of an upper casing member 27 to extend therefrom for covering an upper section of the lower casing valve portion 26*g*. Four air-discharge holes 42*a*-42*d* each of which constitutes an air-discharge passage are formed in the lower valve casing portion 26*g*. The four air-discharge holes 42*a*-42*d* are provided for the respective four colors of inks and extend in parallel to one another. In each of the air-discharge holes 42*a*-42*d*, a valve member 44 (which will be described) is provided so as to be movable in a direction of extension of the air-discharge holes i.e., in a direction of extension of the air-discharge passages), whereby the air-discharging valve devices 15 are constituted. The air-discharge holes 42*a*-42*d* extend in a vertical direction and are open at opposite ends thereof Each of the air-discharge holes 42*a*-42*d* has an upper large-diameter portion 42A and a lower small-diameter portion 42B which communicate with each other via a communication opening 42C. The discharge-air introducing passages 41*a*-41*d* formed in the upper casing member 27 extend to the upper valve casing portion 27*h* and communicate with respective upper ends of the large-diameter portions 42A of the corresponding air-discharge holes 42*a*-42*d*. The discharge-air introducing passages 41*a*-41*d* are for introducing the discharge air into the corresponding air-discharge holes 42*a*-42*d*.

Figure 7A:
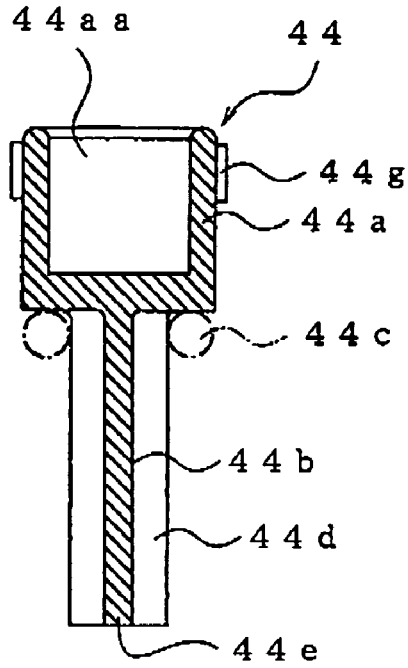

The valve member 44 includes a valve portion and a rod portion 44*b*. The valve portion has a large-diameter valve head 44*a* and a ring-like sealing member 44*c* which is inserted on the rod portion 44*b*. The rod portion 44*b* is connected to a lower end of the valve head. As shown in FIG. 7A, the valve head 44*a* has an outside diameter larger than that of the rod portion 44*b*, and the sealing member 44*c* is in contact with the valve head 44*a*. The valve head 44*a* is opposed, via the sealing member 44*c*, to a stepped surface 42D which is a bottom surface of the large-diameter portion 42A and which is located around the periphery of the communication opening 42C that is an upper open end of the small-diameter portion 42B. The large-diameter valve head 44*a* is inserted in the large-diameter portion 42A of each air-discharge hole 42*a*-42*d* with spacing being left therebetween for permitting the air (gas) to flow therethrough and the rod portion 44*b* is inserted in the small-diameter portion 42B with spacing being left therebetween for permitting the air (gas) to pass therethrough. For placing each air-discharging valve device 15 in an open state (hereinafter may be referred to as a "valve-open state"), the valve member 44 needs to be pushed up by a corresponding push-up-pin portion 76*b* (as an operating portion) provided on an operating member 76 as described below. Accordingly, the lower end portion of the rod portion 44*b* of each valve member 44 inserted in the small-diameter portion 42B reaches in the vicinity of the lower open end of the small-diameter portion 42B. The sealing member 44*c* is suitably provided by a packing of a rubber elastic body, for instance. In the present embodiment, an O-ring is used as the sealing member 44*c*.

The stepped surface 42D which is located around the periphery of the communication opening 42C communicating with the atmosphere functions as a valve seat surface, and the sealing member 44*c* is disposed between the stepped surface 42D (the valve seat surface) and the valve head 44*a*. Accordingly, the communication opening 42C is opened and closed by the valve head 44*a* via the sealing member 44*c*. Hereinafter, the stepped surface 42D may be referred to as "the valve seat surface 42D".

Figure 8:
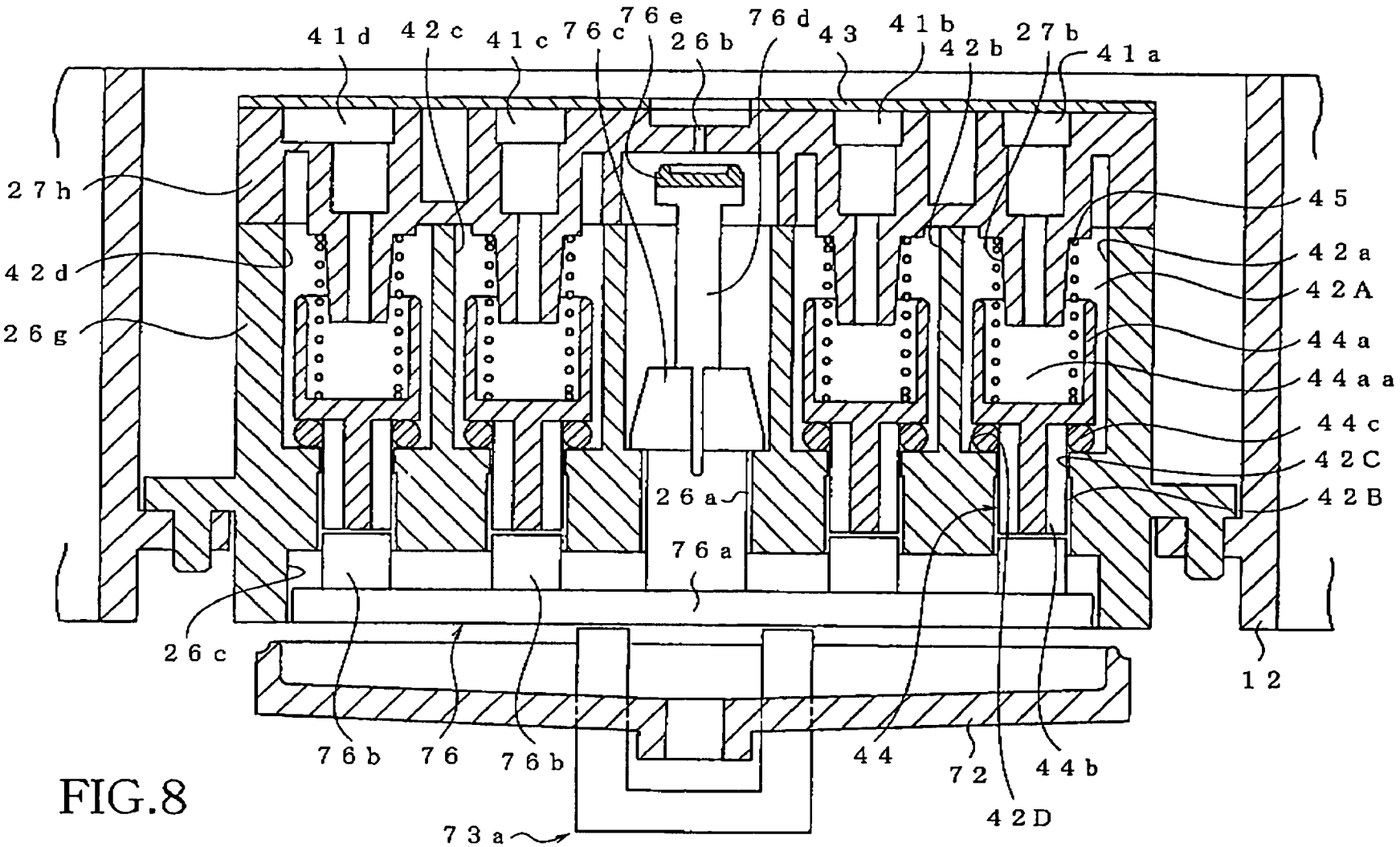
FIG. 8 is a cross sectional view taken along line 8-8 in FIG. 4.

As shown in FIG. 8, a coil spring 45 is inserted in the large-diameter portion 42A of each air-discharge hole 42*a*-42*d*. The coil spring 45 functions as biasing means for biasing the valve member 44 (the valve head 44*a*) in a direction to close the communication opening 42C. The upper end portion of the coil spring 45 is fitted or inserted on a supporting protrusion 27*b* of the upper casing member 27 while the lower end portion thereof is inserted in an upper recess 44*aa* of the valve head 44*a*. The coil spring 45 biases the valve member 44 (the valve head 44*a*) in a direction in which the sealing member 44*c* is held in abutting contact with the valve seat surface 42D. In a normal state wherein the pressing force by the push-up-pin portion 76*b* does not act on the valve member 44, each air-discharging valve device 15 is in a closed state (i.e., valve-close state) to close the communication opening 42C.

Figure 7B:
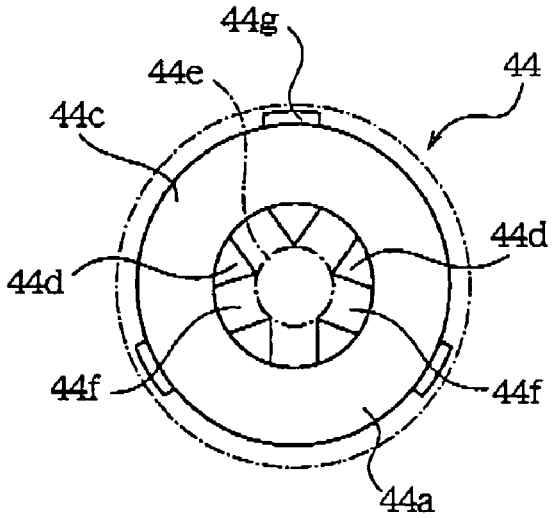

As shown in FIGS. 7A and 7B, the rod portion 44*b* of the valve member 44 includes: a plurality of protruding portions 44*f* (five protruding portions in this embodiment) which are formed on the outer circumferential surface thereof such that the protruding portions extend in directions away from the center axis of the rod portion 44*b* and are equiangularly spaced apart from each other in the circumferential direction of the rod portion 44*b;* and a plurality of grooves 44*d* (five grooves in this embodiment) each of which is formed between adjacent two protruding portions 44*f*. In a different viewpoint, the protruding portions 44*f* protrude from an intersecting point 44*e* of a transverse cut plane of the rod portion 44*b* which is perpendicular to the moving direction of the valve member 44 (perpendicular to the direction of extension of the discharge-air passages) and the center axis line of the valve member 44 which extends in the moving direction, such that the protruding portions 44*f* are equiangularly spaced apart from each other in the circumferential direction of the rod portion 44*b* centered about the intersecting point 44*e*. The number of the protruding portions 44*f* is made equal to the number of the grooves 44*d*. In the present embodiment, the grooves 44*d* are formed so as to extend over the entire axial length of the rod portion 44*b*. The number of the protruding portions 44*f* is not limited to five, but may be suitably determined, as long as the protruding portions 44*f* are formed in a plural number and are arranged in the circumferential direction of the rod portion 44*b*.

Each of the five grooves 44*d* formed in the rod portion 44*b* functions as a passage for permitting passing of the air between the valve head 44*a* and sealing member 44*c* when the valve head 44*a* and the sealing member 44*c* are separated away form each other.

As shown in FIG. 6, the maintenance unit 70 includes: a first cap portion 71 which is operable to fluid-tightly cover the nozzle-opening surface of the recording head 11 in which the nozzle holes 16*a*-16*d* are formed; and a second cap portion 72 which is operable to fluid-tightly close an outer space located outside of an outlet of each air-discharging valve device 15*a* which is a lower end opening of each air-discharging valve device 15 (i.e., a lower end opening of the small-diameter portion 42B). The first and second cap portions 71, 72 are connected integrally to each other with a predetermined spacing distance interposed therebetween. The second cap portion 72 may be arranged to individually close outer spaces located outside of the outlets of the respective air-discharging valve devices 15.

The first and second cap portions 71, 72 are arranged to be vertically moved by a first moving device 73A having a structure similar to that of a known maintenance unit. Therefore, the single moving device 73A enables both of a movement of the first cap portion 71 for fluid-tightly closing the nozzle-opening surface of the recording head 11 to perform the maintenance operation and a movement of the second cap portion 72 for fluid-tightly closing the outer space located outside of the outlets of the air-discharging valve devices 15 such that the operating member 76 disposed in the vicinity of the outlets is included, to perform the maintenance operation. Accordingly, this arrangement simplifies a mechanism which performs a capping operation for fluid-tightly closing the nozzle-opening surface and the outer space and which performs a capping-release operation for permitting the first and second cap portions 71, 72 to move away from the nozzle-opening surface and the outer space.

The first moving device 73A is controlled by a control device 82 (which will be described) to move the first and second cap portions 71, 72 to a first position at which the first and second cap portions 71, 72 are advanced to fluid-tightly close the nozzle-opening surface of the recording head 11 and the outer space located outside of the outlets of the air-discharging valve devices 15, when a position-detecting sensor 83 detects that the recording head 11 is moved to a stand-by position at which the recording head 11 does not perform the recording or printing operation. In the meantime, when the recording head 11 is located at a position other than the stand-by position, the first moving device 73A is controlled by the control device 82 to move the first and second cap portions 71, 72 to a second position at which the first and second cap portions 71, 72 are retracted from the first position and are spaced from the nozzle-opening surface and the outer space, to release the fluid-tight closing by the first and second cap portions 71, 72.

The first cap portion 71 is connected to a suction pump 74 as in the known maintenance unit, so that thickened or viscosity-increased ink and foreign matter are sucked by actuating the suction pump 74, so as to be removed from the nozzle holes 16*a*-16*d*.

Figure 9:
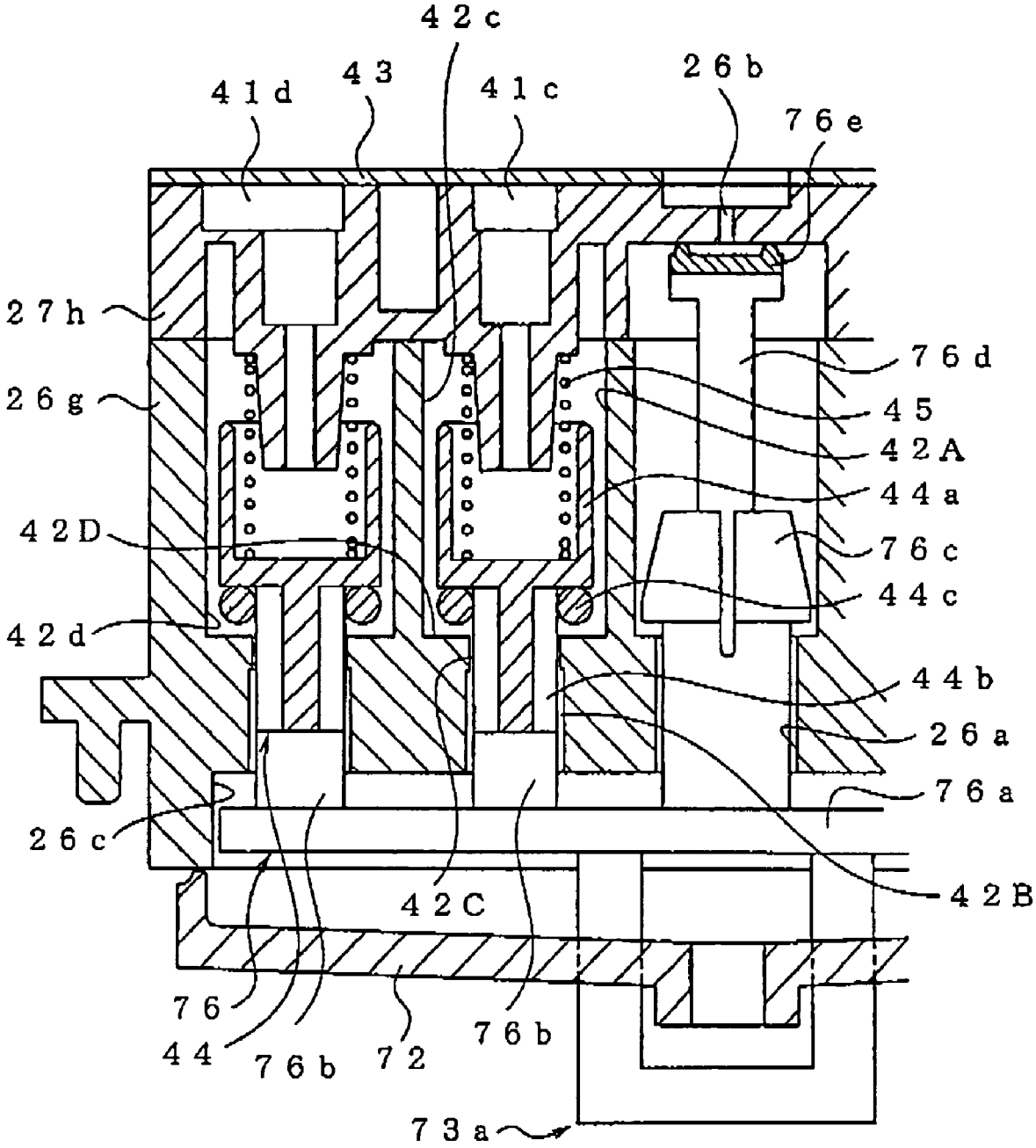
FIG. 9 is a view for explaining an operation of discharging the air.

As shown in FIGS. 8 and 9, the operating member 76 which operates the air-discharging devices 15 are provided with a plurality of push-up-pin portions 76*b* (each functioning as an operating portion) which protrude from a base portion 76*a* of the operating member 76 that extends in a direction of the row of the air-discharging valve devices 15, such that the push-up-pin portions 76*b* correspond respectively to the small-diameter portions 42B of the respective air-discharging valve devices 15. The operating member 76 is movably provided in the lower valve casing portion 26*g*. Described in detail, the lower valve casing portion 26*g* is formed with a recess 26*c* which permits the outlets of the air-discharging valve devices 15 to communicate with one another. The base portion 76*a* of the operating member 76 is accommodated in the recess 26*c* and the push-up-pin portions 76*b* are inserted into the respective small-diameter portions 42B so as to be movable in the direction of extension of the air-discharge passages. Each push-up-pin portion 76*b* is arranged to push the corresponding valve member 44 by a movement thereof in the direction of extension of the air-discharge passages and thereby opens the communication opening 42C, so that the corresponding air-discharging valve device 15 is placed in the valve-open state. There are formed spacing between the outer periphery of the base portion 76*a* of the operating member 76 and the inner periphery of the recess 26*c* and between the outer periphery of each push-up-pin portion 76*b* and the inner periphery of the corresponding air-discharge hole 42*a*-42*d*. Through the thus formed spacing, the air-discharge holes 42*a*-42*d* are open to the lower surface of the lower valve casing portion 26*g*.

The width of the lower surface of the base portion 76*a* as measured in the moving or scanning direction of the carriage 12 (i.e., the width thereof indicated in FIG. 6) is made larger than the diameter of the outlet of each air-discharge hole 42*a*-42*d*. The length of the lower surface of the base portion 76*a* (perpendicular to the width) is larger than the length of the row of the air-discharge hoes 42*a*-42*d*. Namely, the area of the lower surface of the base portion 76*a* is sufficiently larger than a total area of the outlets of the four air-discharge holes 42*a*-42*d*, thereby assuring that a movable member 73*a* (which will be described) is opposed to the lower surface of the base portion 76*a* with high reliability and ease. Should the movable member 73*a* is arranged to be inserted into the respective air-discharge holes 42*a*-42*d* and directly push up the respective rod portions 44*b*, the carriage 12 needs to stop at the stand-by position with high accuracy. In the present arrangement, however, even if the carriage 12 does not stop at the stand-by position with high accuracy, the movable member 73*a* can push up the rod portions 44*b* via the base portion 76*a* of the operating member 76 with high reliability.

The operating member 76 (the base portion 76*a*) is exposed at its lower surface from the recess 26*c*, and the exposed lower surface is substantially flush with the nozzle-opening surface of the recording head 11 which is provided alongside of the recess 26*c*. Because the nozzle-opening surface of the recording head 11 and the lower surface of the operating member 76 are substantially flush with each other, the nozzle-opening surface and the lower surface can be continuously or successively cleaned. Further, this arrangement does not cause interference of the paper sheet P and the operating member during the movement of the carriage 12.

The operating member 76 has an engaging portion 76*c* which is provided at a middle portion thereof and which extends in the same direction as the direction of extension of the push-up-pin portions 76*b* and in parallel with the push-up-pin portions 76*b*. In the meantime, the lower valve casing portion 26*g* is formed with a guide hole portion 26*a* which extends in parallel with the center axis of the air-discharge holes 42*a*-42*d*. The guide hole portion 26*a* has a lower small-diameter section and an upper large-diameter section with a stepped surface interposed therebetween. The engaging portion 76*c* of the operating member 76 slidably engages the lower small-diameter section of the guide hole portion 26*a* with a clearance provided therebetween for permitting a flow of the air therethrough. By the engagement of the engaging portion 76*c* and the guide hole portion 26*a*, the push-up-pin portions 76*b* (the operating portions) are moved or guided in the direction of extension of the air-discharge passages. The operating member 76 is supported or held by the lower valve casing portion 26*g* with a large-diameter head which is provided at an upper end of the engaging portion 76*c* being held in abutting contact with the stepped surface of the guide hole portion 26*a*. Thus, the operating member 76 is arranged to move together with the carriage 12.

At an upper end of the guide hole portion 26*a*, there is formed an atmosphere communication hole 26*b* which communicates with the atmosphere (the outside air). When the air-purging operation is performed, the atmosphere communication holes 26*b* is closed, via a seal portion 76*e*, by a closing portion 76*d* which is provided on the operating member 76 so as to extend upwardly farther than the push-up-pin portions 76, as shown in FIG. 9.

The operating member 76 (the push-up-pin portions 76*b*) is vertically moved by the movable member 73*a* of a second moving device 73B as a valve opening-and-closing device, which is different from the first moving device 73A. Namely, the operating member 76 is accommodated within the lower part of the lower valve casing portion 26*g* and is vertically moved by the second moving device 73B disposed outside of the carriage 12. The movable member 73*a* is vertically slidably supported by the second cap portion 72 such that the movable member 73*a* extends through the bottom portion of the second cap portion 72. The movable member 73*a* pushes a substantially central portion of the lower surface of the operating member 76 (the base portion 76*a*), whereby the operating member 76 is moved in the direction of extension of the air-discharge passages without being inclined.

When the recording head 11 moves to the stand-by position at which the recording operation is not performed, the first and second cap portions 71, 72 are moved upward so that the first cap portion 71 fluid-tightly closes the nozzle-opening surface of the recording head ii and the second cap portion 72 is brought into close contact with the lower surface of the lower valve casing portion 26*g* surrounding the recess 26*c*, that is, the second cap portion fluid-tightly closes the outer space located outside of the outlets of the air-discharging devices 15. At this time, the rod portions 44*b* are pushed upwards by the push-up-pin portions 76 by the operation of the second moving device 73B. In this instance, as shown in FIG. 9, the sealing member 44*c* of each valve member 44 is moved together with the valve head 44*a* of the corresponding valve member 44, whereby the air-discharge holes 42*a*-42*d* are opened, namely, the communication openings 42C are opened, so that the air-discharging valve devices 15 are placed in the valve-open state. In the valve-open state of the air-discharging valve devices 15, the bubbles in the storage chambers 31*a*-31*d* can be discharged through the discharge-air introducing passages 41*a*-41*d*, the air-discharge holes 42*a*-42*d*, the second cap portion 72, and the suction pump 74. Even where, in the valve-open state, only the rod portion 44*b* is moved upward whereas the sealing member 44*c* remains on the valve-seat surface 42D due to the ink adhering between the sealing member 44*c* and the valve-seat surface 42D with which the sealing member 44*c* is in contact, the communication opening 42C is opened through the grooves 44*d* as described above, whereby the bubbles can be discharged. Accordingly, it is avoidable that the bubbles (the air) continue to accumulate in the storage chambers 31*a*-31*d* and consequently move toward the recording head 11. Therefore, a normal recording or printing operation is not hindered. To deal with a failure that the air-discharging valve devices 15 can not be placed in the valve-open state due to thickening or drying of the ink remaining around the sealing member 44*c* (O-ring), for instance, the outer space located outside of the outlets of the air-discharging valve devices 15 may be constantly capped while the recording head 11 is at the stand-by position. Further, the atmosphere communication hole 26*b* may be configured in a labyrinth form, whereby the atmosphere communication hole 26*b* has a function of preventing drying the ink as well as a function of introducing the atmosphere therethrough as described below.

The second cap portion 72 is connected to the suction pump 74 via a flow passage common to the first cap portion 71. In a state in which the outer space located outside of the outlets of the air-discharging valve devices 15 is fluid-tightly closed, the bubbles accumulated in the storage chambers 31*a*-31*d* can be concurrently sucked and discharged by driving the suction pump 74. In this arrangement, the inks supplied from the respective ink tanks 9*a*-9*d* to the recording head 11 via the respective ink supply tubes 13*a*-13*d* are temporarily stored in the storage chambers 31*a*-31*d* provided in the route of flow of each ink, and the bubbles contained in the inks are separated from the inks and floated on the inks. The thus separated bubbles (the air) are accumulated at the upper portions of the storage chambers 31*a*-31*d*, and are consequently sucked and discharged by the suction pump 74 as described above.

The first cap portion 71 and the second cap portion 72 are selectively connected to the suction pump 74 by a selector valve 75. The first cap portion 71 and the second cap portion 72 are operated by the first moving device 73A to concurrently fluid-tightly close the nozzle-opening surface of the recording head 11 and the outer space located outside of the outlets of the air-discharging valve devices 15, respectively. In this state, the maintenance operation is performed. The maintenance operation is performed desirably according to the following procedure: Initially, the bubbles accumulated at the upper portions of the storage chambers 31*a*-31*d* are discharged through the second cap portion 72. Then, the ink is removed from the nozzle holes 16*a*-16*d* by sucking through the first cap portion 71. The bubbles are discharged through the second cap portion 72 for the following reasons: If the bubbles accumulated in the storage chambers 31*a*-31*d* are intended to be discharged from the recording head 11 only through the first cap portion 71, it is inevitable that considerably large amounts of inks are discharged. In the arrangement described above, however, the discharging of the bubbles and the restoring treatment of the recording head 11 can be carried out with small amounts of inks to be discharged.

While the maintenance operation is performed, in the present embodiment, such that the operation of discharging the bubbles in the storage chambers 31*a*-31*d* and the operation of sucking the inks from the nozzle holes 16*a*-16*d* are carried out in this order, the maintenance operation may be performed such that only the operation of sucking the inks from the nozzle holes 16*a*-16*d* or only the operation of discharging the bubbles in the storage chambers 3la-31*d* may be carried out independently of each other.

The above-described operations of discharging and sucking are controlled by the control device 82 that is connected to the maintenance unit 70 constituted by including the first moving device 73A, the second moving device 73B as the valve opening-and-closing device, the suction pump 74, the selector valve 75, and the position-detecting sensor 83. Described more specifically, when the position-detecting sensor 83 detects that the recording head 11 is moved to the stand-by position, the cap portion 72 is moved by the first moving device 73A to the above-described first position, together with the first cap portion 71, while at the same time, the operating member 76 is moved upwards in the direction of extension of the air-discharge passages by the second moving device 73B, whereby the air-discharging devices 15 are concurrently placed in the valve-open state. In this instance, since the push-up-pin portions 76*b* of the operating member 76 are inserted in advance into the outlets of the respective air-discharging valve devices 15 with the operating member 76 being held in engagement with the lower part of the lower valve casing portion 26*g*, it is not necessary to insert the push-up-pin portions 76*b* into the outlets of the respective air-discharging valve devices 15 while being positioned relative to the respective outlets. Accordingly, the air-discharging valve devices 15 can be placed in the valve-open state by simply pushing the operating member 76 upwards by the movable member 73*a* of the second moving device 73B. Further, at the same time when the air-discharging valve devices 15 are placed in the valve-open state, the atmosphere communication holed 26*b* is closed by the closing portion 76*d*.

In the valve-open state of the air-discharging valve devices 15, the suction pump 74 is driven to thereby discharge the air separated in the buffer tank 14 through the discharge-air introducing passages 41*a*-41*d* and the air-discharge holes 42*a*-42*d*. Thus, a first discharge operation is performed. After this first discharge operation, the movable member 73*a* is moved downward to thereby move the operating member 76 downward by gravity or the coil springs 45, thereby placing the air-discharging valve devices 15 in the valve-close state for inhibiting the inside of the buffer tank 14 from communicating with the outside. At the same time, the atmosphere communication hole 26*b* is opened so as to establish an atmosphere-introduction state in which the atmosphere is introduced into the outer space located outside of the outlets of the air-discharging valve devices 15 through the atmosphere communication openings 26*b*. In this state, the insides of the air-discharging valve devices 15, more specifically, the downstream portions of the communication openings 42C, and the inside of the recess 26*c* are exhausted, together with the atmosphere introduced through the atmosphere communication hole 26*b*. Thus, a second discharge operation is performed. By performing the second discharge operation, the inks remaining in the communication openings 42C and the small-diameter portions 42B and remaining around the operating member 76 are sucked together with the introduced atmosphere. Thereafter, the selector valve 75 is switched to connect the first cap portion 71 to the suction pump 74, whereby the operation of sucking the inks from the nozzle holes 16*a*-16*d* of the recording head 11 is carried out. Then, the nozzle-opening surface of the recording head 11, the lower surface of the operating member 76, and the lower surface of the lower valve casing portion 26*g* surrounding the lower surface of the operating member 76 are wiped by a known wiping device not shown, so that the inks are removed therefrom.

Normally when the recording operation is performed by the recording head 11 with the recording head 11 located at a position other than the stand-by position, the air-discharging valve devices 15 are kept in the valve-close state. In this instance, because the inks do not remain in the insides of the air-discharging valve devices 15 and around the operating member 76, the dropping of the inks does not occur during the recording operation by the recording head 11.

Figure 10:
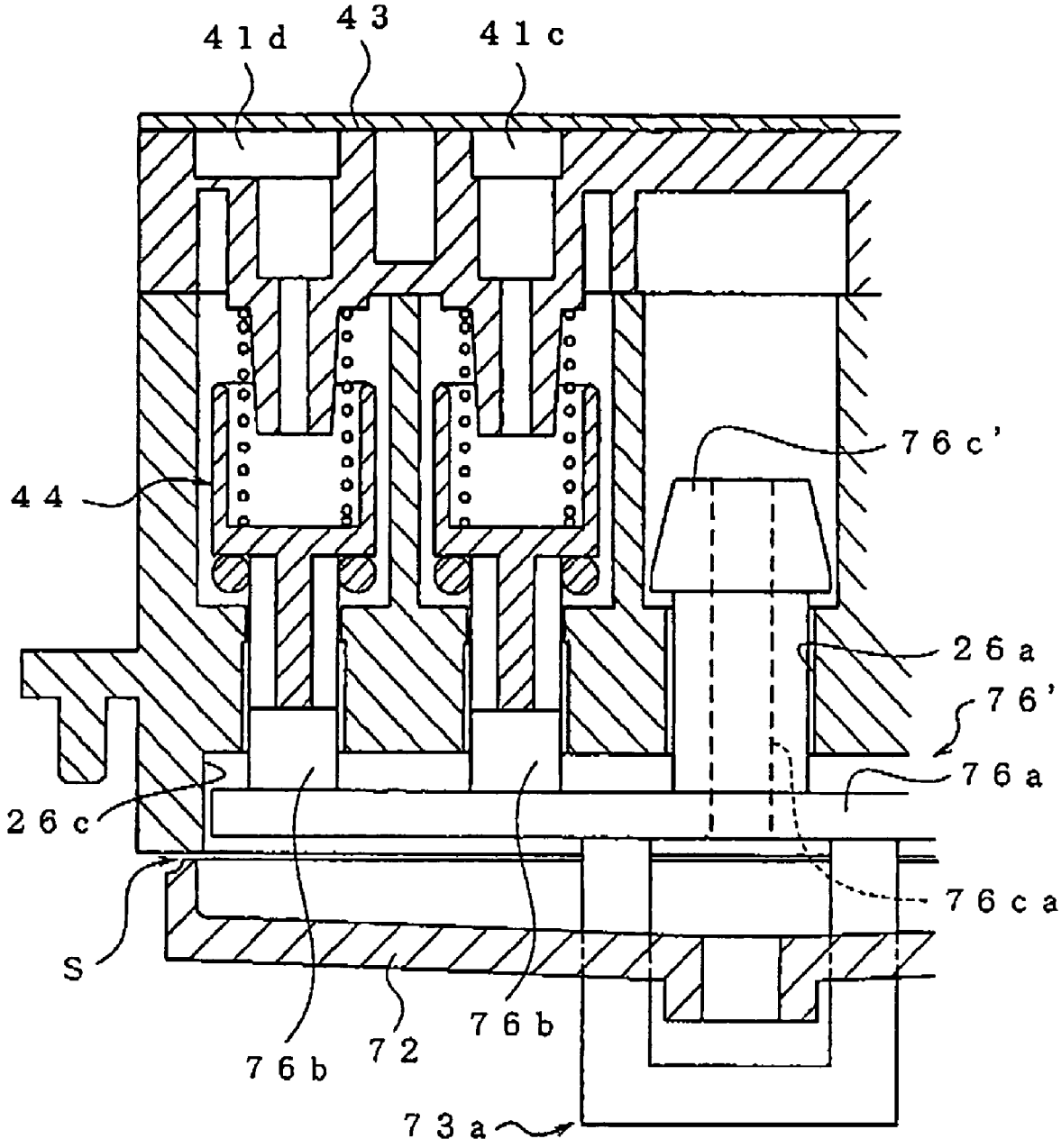
FIG. 10 is a view for explaining a modified arrangement of FIG. 6, the view corresponding to FIG. 9.

The atmosphere communication hole 26 through which the atmosphere is introduced at the time of execution of the second discharge operation is not necessarily provided, as shown in FIG. 10 indicating a modified arrangement of the illustrated first embodiment. In this modified arrangement, the same or similar reference numerals as used in the illustrated first embodiment are used to identify the corresponding components, and a detailed explanation of which is dispensed with. In the modified arrangement, after the first discharge operation, the second cap portion 72 is moved downward from the first position to a third position at which the second cap portion 72 is spaced apart from the lower surface of the lower valve casing portion 26*g* with a small clearance S interposed therebetween. Namely, the second discharge operation is executed with the cap portion 72 located at the third position at which the cap portion 72 is retracted from the first position to slightly release the fluid-tight closing of the outer space by the cap portion 72 for introducing the atmosphere into the outer space through the small clearance S. In other words, the inks remaining in the communication openings 42C and the recess 26*c* may be arranged to be removed while the atmosphere is sucked into the outer space through the small clearance S. The engaging portion 76*c*' of the operating member 76' is formed with a through-hole 76*ca*, thereby allowing the atmospheric pressure to act on the upper side of the operating member 76' via the through-hole 76*ca* after the second cap portion 72 is separated from the lower surface of the lower valve casing portion 26*g* and before the second discharge operation is executed. Thus, this arrangement permits the operating member 76' to be easily moved downward.

Figure 11:
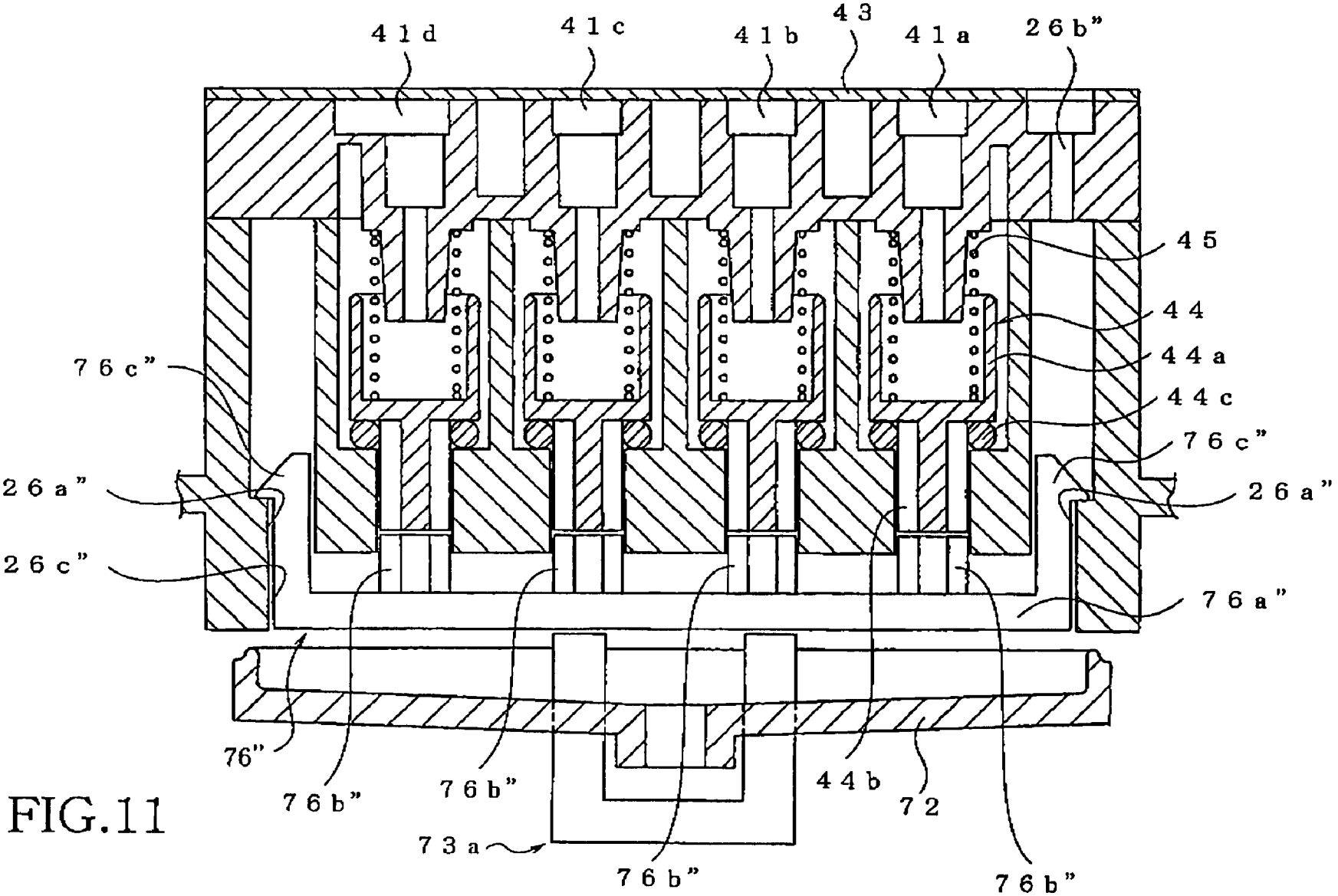
FIG. 11 is a view for explaining a second embodiment of the invention, the view corresponding to FIG. 8.

Referring next to FIG. 11, there will be explained a second embodiment of the invention in which the same or similar reference numerals as used in the illustrated first embodiment and the modified arrangement thereof are used to identify the corresponding components, and a detailed explanation of which is not given.

While the engaging portion 76*c*, 76*c*' of the operating member 76, 76' in the illustrated first embodiment or the modified arrangement thereof is provided at a middle portion of the operating member 76, 76', the engaging portion may be provide otherwise, as shown in the second embodiment of FIG. 11. Described in detail, in the second embodiment, the engaging portion 76*c*" is provided on opposite ends of the operating member 76" so as to be symmetrical to each other, and the engaging member 76" is arranged to slidably engage the guide hole portion 26*a*". In this case, while not shown, the operating member 76" is provided with the closing portion 76*d* which is opposed to the atmosphere communication opening 26*b*", as in the illustrated first embodiment shown in FIG. 8, and the atmosphere communication hole 26*b*" is arranged to be closed by the closing portion 76*d* when the air-discharging valve devices 15 are placed in the valve-open state. Further, the push-up-pin portions 76*b*" of the operating member 76" are configured to have a size that allows the push-up-pin portions 76*b*" to slidably move along the inner circumference of the corresponding small-diameter portions 42B, whereby the operating member 76" can be vertically moved without being inclined owing to the sliding movement of the push-up-pin portions 76*b*" disposed at a plurality of positions on the operating member 76". In this instance, each push-up-pin portion 76*b*" has a plurality of grooves formed on its outer circumferential surface, like the rod portion 44*b* having the grooves 44*d*, for assuring a flow of the discharge air between each push-up-pin portion 76*b*" and the inner circumference of the corresponding small-diameter portion 42B.

Figure 12:
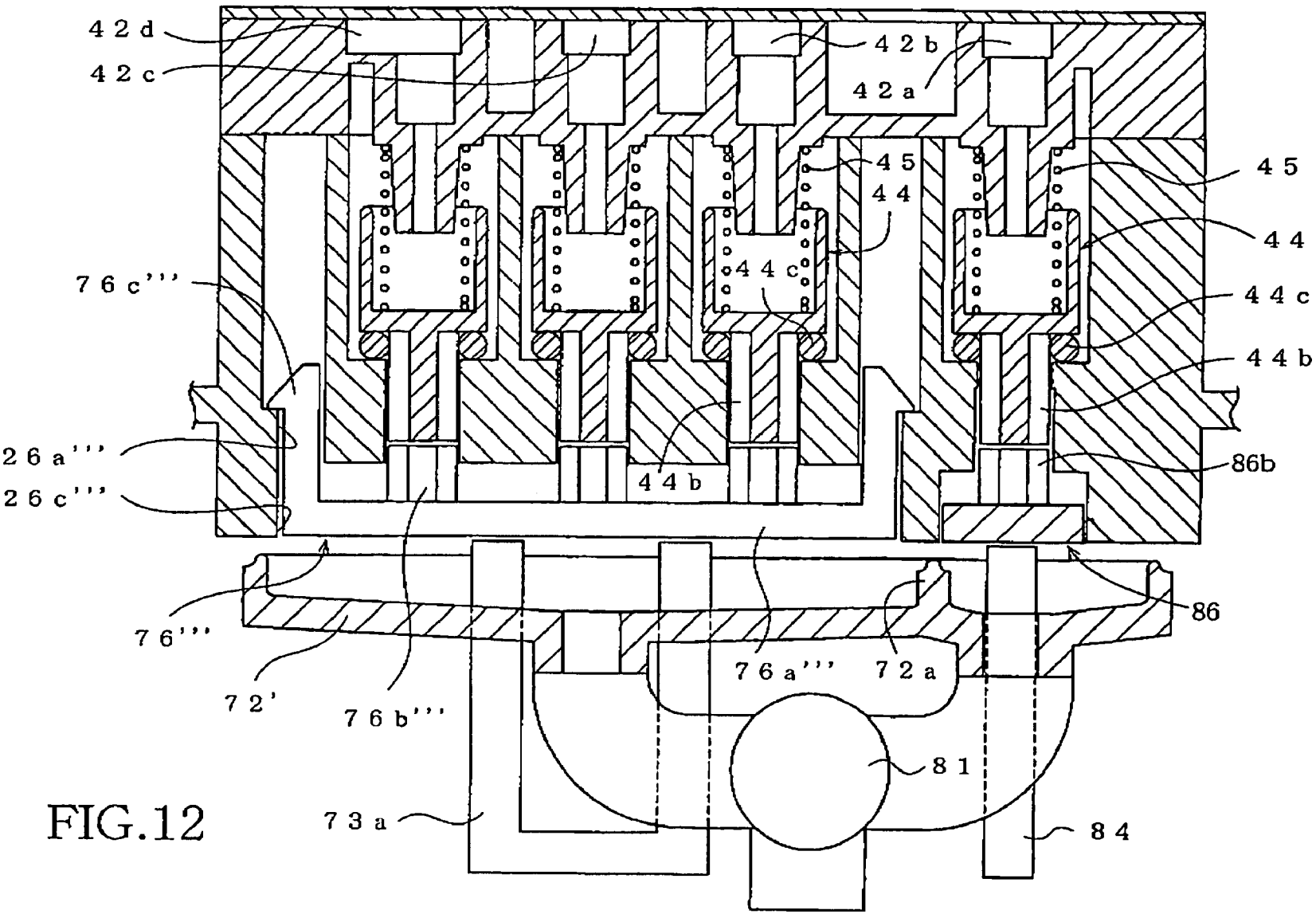
FIG. 12 is a view for explaining a third embodiment of the invention, the view corresponding to FIG. 8.

Referring next to FIG. 12, there will be explained a third embodiment of the invention in which the same or similar reference numerals as used in any of the illustrated first and second embodiments are used to identify the corresponding components, and a detailed explanation of which is not given.

All of the air-discharging valve devices 15 may not be placed in the valve-open state and the valve-close state by a single operating member. Described in detail with respect to the third embodiment shown in FIG. 12, one operating member 76'" may be provided for a part of the air-discharging valve devices 15 (i.e., the left-hand three air-discharging valve devices in FIG. 12) and another operating member 86 may be provided for the rest of the air-discharging valve devices 15 i.e., the right-hand one air-discharging valve device in FIG. 12). The operating member 76'" and the operating member 86 may be arranged to be independently operated by the mutually different movable members 73*a*, 84, respectively. In this third embodiment shown in FIG. 12, a resistance to the flow of the black ink flowing through the ink supply tube, the storage chamber, and the air-discharge passage provided exclusively for the black ink which tends to be consumed in a relatively large amount is made smaller than that of each of the inks of the other colors except the black ink, which inks of the other colors tend to be consumed in a relatively small amount. Therefore, the air-discharging valve devices are divided into two groups and the discharge operation is performed independently for each of the two groups, for performing the discharge operation in an optimum manner by considering the difference in the resistance to flow between the black ink and the other inks of the other colors. In this third embodiment, the cap portion 72' has a partition wall 72*a* which divides the cap portion 72' into two sections, namely, a first section corresponding to the above-described part of the air-discharging valve devices for fluid-tightly closing an outer space located outside of the outlets of those air-discharging valve devices and a second section corresponding to the above-described rest of the air-discharging valve devices for fluid-tightly closing an outer space located outside of the outlet of the air-discharging valve device. The first and second sections of the cap portion 72' are selectively connected to the suction pump 74 by a selector valve 81, whereby the discharge operation can be performed independently for each of the two groups of the air-discharging valve devices. As in the illustrated second embodiment, in this third embodiment, the engaging portion 76*c*''' slidably engages the guide hole portion 26*a*''' and the operating member 76''' is movably accommodated in the recess 26*c*''' of the lower valve casing portion. The operating member 86 has an engaging portion similar to that of the operating member 76 at its opposite ends as seen in a direction perpendicular to the plane of FIG. 12, and is supported by the lower valve casing portion owing to engagement of the engaging portion and the guide hole portion.

In this third embodiment, too, the width of the base portion 76*a*''' of the operating member 76''' as measured in the moving direction of the carriage 12 (the scanning direction of the carriage 12) is made larger than the diameter of each of the air-discharge holes 42*b*-42*d* and the length of the base portion 76*a*''' as measured in a direction perpendicular to the moving direction of the carriage 12 is made larger than the length of the row of the air-discharge holes 42*b*-42*d*. Similarly, the width of the operating member 86 as measured in the moving direction of the carriage 12 and the length thereof as measured in the direction perpendicular to the moving direction of the carriage 12 are also made larger than the diameter of the outlet of the air-discharge hole 42*a*. Therefore, in this third embodiment, even if the accuracy with which the carriage 12 stops at the stand-by position is low, the movable members 73*a*, 84 are arranged to be easily opposed to the operating members 76''', 86.

Figure 13:
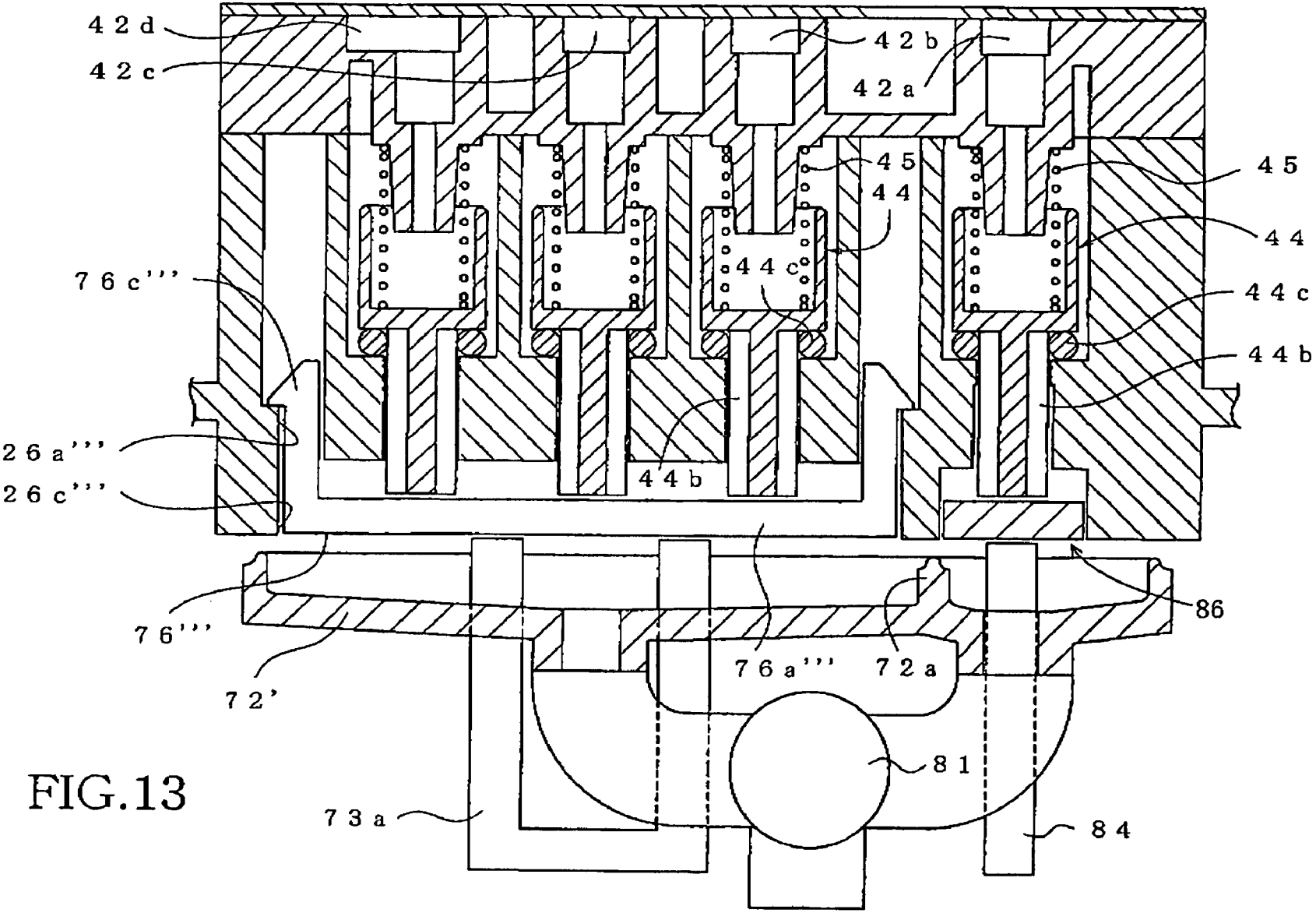
FIG. 13 is a view for explaining a fourth embodiment of the invention, the view corresponding to FIG. 8.

Referring next to FIG. 13, there will be explained a fourth embodiment of the invention in which the same or similar reference numerals as used in any of the illustrated first through third embodiments are used to identify the corresponding components, and a detailed explanation of which is omitted.

The operating members 76''', 86 are not necessarily provided with the respective push-up-pin portions 76*b*''', 86*b*. Described in detail with respect to the fourth embodiment shown in FIG. 13, the rod portions 44*b* may be configured such that the lower end portions thereof extend beyond the outlets (the lower end openings) of the corresponding air-discharge holes 42*a*-42*d*, and the lower end portions of the rod portions 44*b* may be pushed up by the upper surfaces of the base portions of the operating members 76''', 86.

Figure 14:
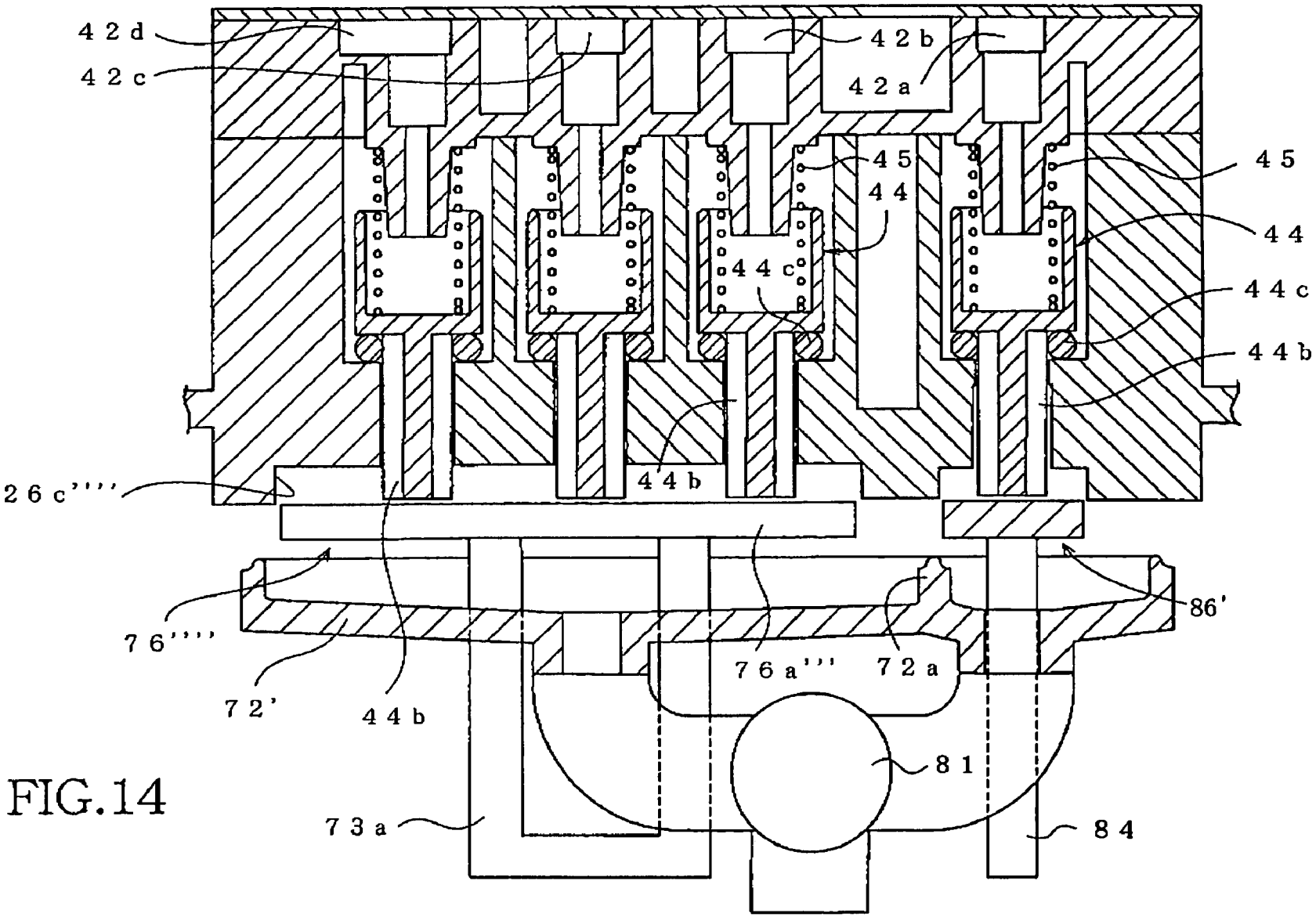
FIG. 14 is a view for explaining a fifth embodiment of the invention, the view corresponding to FIG. 8.

Referring next to FIG. 14, there will be explained a fifth embodiment of the invention in which the same or similar reference numerals as used in any of the illustrated first through fourth embodiments are used to identify the corresponding components, and a detailed explanation of which is omitted.

The operating member is not necessarily provided on the lower valve casing portion side (26*g*), i.e., on the carriage side (12). For instance, in the fifth embodiment shown in FIG. 14, the operating members 76'''', 86' are connected respectively to one ends (the upper ends) of the movable members 73*a*, 84 nearer to the air-discharging valve devices. In this embodiment, too, when the carriage 12 is moved to the stand-by position, the movable members 73*a*, 84 are opposed to the lower ends of the rod portions 44*b* via the operating members 76'''', 86' and the air-discharging valve devices 15 are placed in the valve-open state by moving the movable members 73*a*, 84 upwards.

While the preferred embodiments of the present invention have been described in detail by reference to the drawings, it is to be understood that the present invention may be otherwise embodied.

Each of the illustrated embodiments is explained with respect to a case wherein the valve member 44 of each air-discharging valve device 15 moves in the vertical direction. The direction of movement of the valve member 44 is not limited to the vertical direction, but may be any direction other than the vertical direction.

In place of the sucking operation by the suction pump 74, it is possible to suck and remove the viscosity-increased or thickened ink and the foreign matter from the nozzle holes 16*a*-16*d* and discharge the bubbles in the storage chambers 31*a*-31*d*, by applying positive pressure to the inks in the ink tanks. It is also possible to employ the sucking operation by the suction pump 74 and the application of the positive pressure to the inks in combination.

It is to be understood that the present invention may be embodied with various other changes and modifications, which may occur to those skilled in the art, without departing from the spirit and scope of the invention defined in the appended claims.

What is claimed is:

1. An ink-jet printer, comprising:

a carriage which moves along a recording medium;

a recording head which is mounted on the carriage and which performs recording on the recording medium by ejecting ink from nozzle holes;

an ink tank provided outside of the carriage;

a case body mounted on the carriage, the case body including a buffer tank with a storage chamber to store ink supplied from the ink tank;

an air-discharged passage, disposed in the case body, through which air separated from the ink in the storage chamber is discharged;

an air-discharging valve device, disposed in the case body, and in fluid communication with the air-discharge passage to open and close the air-discharge passage;

a valve opening-and-closing device which is provided outside of the carriage and which operates the air-discharging valve device between a valve-open state and a valve-close state; and an operating member interposed between the air-discharging valve device and the valve opening-and-closing device, wherein the operating member is movable by the valve opening-and-closing device, so that the air-discharging valve device is operated to be place in the valve-open state and the valve-close state via the operating member, when the carriage is moved to a predetermined position;

wherein the operating member is provided on the carriage so as to be movable in a direction in which the air-discharging valve device is operated to be placed in the valve-open state and valve-close state, wherein, when the carriage is moved to the predetermined position, the valve opening and-closing device is opposed to the operating member, wherein the ink tank is provided in a plural number to give a plurality of ink tanks, the storage chamber of the buffer tank is provided in the plural number to give a plurality of storage chambers that respectively correspond to a plurality of inks supplied from the plurality of ink tanks, the air-discharge passage is provided in the plural number to give a plurality of air-discharge passages that respectively correspond to the plurality of storage cambers, and the air-discharging valve device is provided in the plural number to give a plurality of air-discharging valve devices that respectively correspond to the plurality of air-discharge passages, and wherein the operating member is arranged to be located so as to be opposed to at least two of the plurality of air-discharging valve devices, so that, when the carriage is moved to the predetermined position, the valve opening-and-closing device moves the operating member such that the at least two of the plurality of air-discharging valve devices are simultaneously operated.

2. The ink-jet printer according to claim 1, wherein the operating member has a size larger than a size of an outlet of the air-discharge passage, as measured in a moving direction of the carriage.

3. The ink-jet printer according to claim 1, wherein the air-discharging valve device includes a valve member which is movable in a direction of extension of the air-discharge passage, and wherein the operating member is arranged to be opposed to the valve member and movable in the direction of extension of the air-discharge passage so as to push the valve member, whereby the air-discharging valve device is operated to be placed in the valve-open state.

4. The ink-jet printer according to claim 1, wherein a recess partially constituting the air-discharging valve device is formed at an end of the case body, and the operating member is movably accommodated in the recess.

5. The ink-jet printer according to claim 4, wherein the recess is formed alongside of a nozzle-opening surface of the recording head in which the nozzle holes are open and one surface of the operating member which is exposed from the recess is substantially flush with the nozzle-opening surface of the recording head.

6. The ink-jet printer according to claim 1, wherein a guide hole portion partially constituting the air-discharging valve device is provided in the case body and the operating member has an engaging portion which engages the guide hole portion so as to be movable in a direction of extension of the air-discharge passage.

7. The ink-jet printer according to claim 1, wherein the operating member is connected to an end of the valve opening-and-closing device, which end is near to the air-discharging valve device, and wherein, when the carriage is moved to the predetermined position, the valve opening-and-closing device is opposed to the air-discharging valve device via the operating member.

8. The ink-jet printer according to claim 1, wherein the operating member is provided to correspond to all of the plurality of air-discharging valve devices.

9. The ink-jet printer according to claim 1, wherein the operating member is provided to correspond to a part of the plurality of air-discharging valve devices, and wherein the ink-jet printer further comprises another operating member which corresponds to the rest of the plurality of air-discharging valve devices.

10. The ink-jet printer according to claim 1, further comprising an exhaust device which is provided outside of the carriage and is connectable to the air-discharge passage when the carriage is moved to the predetermined position.

11. The ink-jet printer according to claim 1, wherein the ink tank is provided in a plural number to give a plurality of ink tanks, the storage chamber of the buffer tank is provided in the plural number to give a plurality of storage chambers that respectively correspond to a plurality of inks supplied from the plurality of ink tanks, the air-discharge passage is provided in the plural number to give a plurality of air-discharge passages that respectively correspond to the plurality of storage chambers, and the air-discharging valve device is provided in the plural number to give a plurality of air-discharging valve devices that respectively correspond to the plurality of air-discharge passages, wherein the operating member is movably provided on the carriage for simultaneously operating at least two of the plurality of air-discharging valve devices;

and wherein, when the carriage is moved to the predetermined position, the operating member is moved by the valve opening-and-closing device such that the at least two of the plurality of air-discharging valve devices are simultaneously operated.

12. The ink-jet printer according to claim 11, wherein the operating member has a size larger than a size of an outlet of each of the plurality of air-discharge passages, as measured in a moving direction of the carriage.

13. The ink-jet printer according to claim 11, wherein each of the at least two of the plurality of air-discharging valve devices includes a valve member which is movable in a direction of extension of at least two of the plurality of air-discharge passages which correspond to the at least two of the plurality of air-discharging valve device and which extend in parallel to each other, and wherein the operating member is arranged to be opposed to the valve members of the at least two of the plurality of air-discharge valve devices and movable in the direction of extension of the plurality of air-discharge passages so as to push the valve members, whereby the at least two of the plurality of air-discharging valve devices are operated to be placed in the valve-open state.

14. The ink-jet printer according to claim 11, wherein a recess partially constituting the at least two of the plurality of air-discharging valve devices is formed at an end portion of the case body, and the operating member is movably accommodated in the recess.

15. The ink-jet printer according to claim 14, wherein the recess is formed alongside of a nozzle-opening surface of the recording head in which the nozzle holes are open and one surface of the operating member which is exposed from the recess is substantially flush with the nozzle-opening surface of the recording head.

16. The ink-jet printer according to claim 11, wherein a guide hole portion partially constituting the at least two of the plurality of air-discharging valve devices is provided in the case body, and the operating member has an engaging portion which engages the guide hole portion so as to be movable in a direction of extension of the at least two of the plurality of air-discharge passages.

17. The ink-jet printer according to claim 11, further comprising an exhaust device which is provided outside of the carriage and is connectable to the plurality of air-discharge passages when the carriage is moved to the predetermined position.

18. The ink-jet printer according to claim 1, wherein the ink-jet printer is arranged to execute: a first discharge operation in which the air separated from the ink in the buffer tank is discharged through the air-discharge passage while fluid-tightly closing an outer space outside of an outlet of the air-discharging valve device and placing the air-discharging valve device in the valve-open state; and a second discharge operation in which an inside of the air-discharging valve device is exhausted together with an atmosphere introduced into the outer space while placing the air-discharging valve device in the valve-close state.

19. The ink-jet printer according to claim 18, wherein the ink-jet printer further comprises: a cap member which can fluid-tightly close the outer space; a first moving device which moves the cap member between a first position at which the cap member is advanced to fluid-tightly close the outer space of the air-discharging device and a second position at which the cap member is retracted from the first position to release the fluid-tight closing by the cap member; a suction pump which is connected to the cap member; and a control device which controls the valve opening-and-closing device, the first moving device, and the suction pump and which executes, when the recording head is moved the predetermined position, (a) a first-discharge-operation control for controlling the first discharge operation in which the first moving device is controlled to move the cap member to the first position, the valve opening-and-closing device is controlled to place the air-discharging valve device in the valve-open state, and the suction pump is controlled to discharge the air separated from the ink in the buffer tank through the air-discharge passage, and (b) a second-discharge-operation control for controlling the second discharge operation in which the valve opening-and-closing device is controlled to place the air-discharging valve device in the valve-close state, an atmosphere-introduction state is realized for introducing an atmosphere into the outer space, and the suction pump is controlled to exhaust the inside of the air-discharging valve device together with the atmosphere introduced into the outer space.

20. An ink-jet printer, comprising:

a recording head which performs recording on a recording medium by ejecting ink from nozzle holes;

an ink tank for storing ink to be supplied to the recording head;

a buffer tank for storing the ink supplied from the ink tank; and an air-discharging valve device which discharges an air separated from the ink in the buffer tank through an air-discharge passage, wherein the improvement comprises:

the ink-jet printer being arranged to execute: a first discharge operation in which the air separated from the ink in the buffer tank is discharged through the air-discharge passage while fluid-tightly closing an outer space outside of an outlet of the air-discharging valve device and placing the air-discharging valve device in a valve-open state; and a second discharge operation in which an inside of the air-discharging valve device is exhausted together with an atmosphere introduced into the outer space while placing the air-discharging valve device in a valve-close state.

21. The ink-jet printer according to claim 20, further comprising:

a maintenance unit which executes the first discharge operation; and a control device which controls the maintenance unit to execute the second discharge operation after the first discharge operation.

22. The ink-jet printer according to claim 20, further comprising:

a valve opening-and-closing device for placing the air-discharging valve device in the valve-open state and the valve-close state;

a cap member which can fluid-tightly close the outer space;

a first moving device which moves the cap member between a first position at which the cap member is advanced to fluid-tightly close the outer space of the air-discharging device and a second position at which the cap member is retracted from the first position to release the fluid-tight closing by the cap member;

a suction pump which is connected to the cap member; and a control device which controls the valve opening-and-closing device, the first moving device, and the suction pump and which executes, when the recording head is moved to a stand-by position at which the recording head does not perform the recording, (a) a first-discharge-operation control for controlling the first discharge operation in which the first moving device is controlled to move the cap member to the first position, the valve opening-and-closing device is controlled to place the air-discharging valve device in the valve-open state, and the suction pump is controlled to discharge the air separated from the ink in the buffer tank through the air-discharge passage, and (b) a second-discharge-operation control for controlling the second discharge operation in which the valve opening-and-closing device is controlled to place the air-discharging valve device in the valve-close state, an atmosphere-introduction state is realized for introducing an atmosphere into the outer space, and the suction pump is controlled to exhaust the inside of the air-discharging valve device together with the atmosphere introduced into the outer space.

23. The ink-jet printer according to claim 22, wherein an atmosphere communication opening is formed in a casing that partially constitutes the air-discharging valve device, and the atmosphere communication opening is arranged to be closed at the time of execution of the first discharge operation and opened at the time of execution of the second-discharge operation for introducing the atmosphere into the outer space.

24. The ink-jet printer according to claim 23, wherein the atmosphere communication hole is closed in the valve-open state of the air-discharging valve device and opened in the valve-close state thereof, by an operation of the valve opening-and-closing device.

25. The ink-jet printer according to claim 22, wherein when the second discharge operation is executed, the control device controls the first moving device to move the cap member to a third position at which the cap member is retracted from the first position to slightly release the fluid-tight closing by the cap member for introducing the atmosphere into the outer space.

26. The ink-jet printer according to claim 22, wherein the buffer tank has a plurality of storage chambers which respectively store a plurality of inks, and the air-discharge passage and the air-discharging valve device are provided in a plural number to give a plurality of air-discharge passages and a plurality of air-discharging valve devices corresponding to the plurality of storage chambers, wherein each of the plurality of air-discharging valve devices includes: a valve member which is moved in a direction of extension of the plurality of air-discharge passages, whereby each of the plurality of air-discharging valve devices is placed in the valve-open state and the valve-close state, wherein the ink-jet printer further comprises an operating member which is provided so as to correspond to at least two of the plurality of air-discharging valve devices, which has at least two operating portions each corresponding to each of the valve members of each of the at least two of the plurality of air-discharging valve devices, and which engages a casing that partially constitutes the at least two of the plurality of air-discharging valve devices, so as to be movable in the direction of extension of at least two of the plurality of air-discharge passages which correspond to the at least two of the plurality of air-discharging valve devices, wherein the valve opening-and-closing device includes a second moving device having a movable member by which the operating member is moved in the direction of extension of the at least two of the plurality of air-discharge passages, wherein the cap member is located on the downstream side of the operating member as viewed in the direction of extension of the at least two of the plurality of air-discharge passages when the cap member is in the first position, and wherein the second discharge operation is executed such that a space located around the operating member is also exhausted.

27. The ink-jet printer according to claim 26, wherein the casing has a guide hole portion and the operating member has an engaging portion which slidably engages the guide hole portion.

28. The ink-jet printer according to claim 27, wherein the engaging portion is disposed at a middle of the operating member.

29. The ink-jet printer according to claim 27, wherein the guide hole portion is formed with an atmosphere communication hole which is arranged to be closed at the time of execution of the first discharge operation and opened at the time of execution of the second discharge operation for introducing the atmosphere into the outer space.

30. The ink-jet printer according to claim 29, wherein the atmosphere communication hole is closed in the valve-open state of the at least two of the plurality of air-discharging valve devices and opened in the valve-close state thereof, by an operation of the valve opening-and-closing device.

31. The ink-jet printer according to claim 26, wherein the operating member is provided to correspond to all of the plurality of air-discharging valve devices and has a plurality of operating portions that respectively correspond to the valve members of the plurality of air-discharging valve devices.

32. The ink-jet printer according to claim 26, wherein the operating member is provided to correspond to a part of the plurality of air-discharging valve devices, and wherein the ink-jet printer further comprises another operating member which corresponds to the rest of the plurality of air-discharging valve devices and which has operating portions that respectively correspond to the valve members of the rest of the plurality of air-discharging valve devices.

33. The ink-jet printer according to claim 20, further comprising:

a valve opening-and-closing device for placing the air-discharging valve device in the valve-open state and the valve-close state;

a cap member which can fluid-tightly close the outer space;

a first moving device which moves the cap member between a first position at which the cap member is advanced to fluid-tightly closes the outer space and a second position at which the cap member is retracted from the first position to release the fluid-tight closing by the cap member;

a suction pump which is connected to the cap member; and a control device which controls the valve opening-and-closing device, the first moving device, and the suction pump and which executes, when the recording head is moved to a stand-by position at which the recording head does not perform the recording, (a) a first-discharge-operation control for controlling the first discharge operation in which the first moving device is controlled to move the cap member to the first position, the valve opening-and-closing device is controlled to place the air-discharging valve device in the valve-open state, and the suction pump is controlled to discharge the air separated from the ink in the buffer tank through the air-discharge passage, and (b) a second-discharge-operation control for controlling the second discharge operation in which an atmosphere-introduction state is realized for introducing an atmosphere into the outer space, with the cap member positioned such that the fluid-tight closing by the cap member is slightly released, and the suction pump is controlled to exhaust the inside of the air-discharging valve device together with the atmosphere introduced into the outer space.

34. The ink-jet printer according to claim 20, further comprising: a carriage which moves along the recording medium; a valve opening-and-closing device which is provided outside of the carriage and which operates the air-discharging valve device to be placed in a valve-open state and a valve-close state, wherein the buffer tank has a storage chamber which stores the ink supplied from the ink tank, wherein the air-discharging valve device is provided for the air-discharge passage to open and close the air-discharge passage;

and wherein the ink-jet printer further comprises an operating member which is arranged to be interposed between the air-discharging valve device and the valve opening-and-closing device and which is moved by the valve opening-and-closing device, so that the air-discharging valve device is operated to be placed in the valve-open state and the valve-close state via the operating member, when the carriage is moved to a predetermined position.

* * * * *